US005417258A

United States Patent [19]

Privas

[11] Patent Number: 5,417,258

[45] Date of Patent: May 23, 1995

[54] RECHARGEABLE DEVICE FOR SPRAYING A FLUID

[75] Inventor: Yves Privas, Pompano Beach, Fla.

[73] Assignee: Conceptair Anstalt, Liechtenstein, Germany

[21] Appl. No.: 988,419

[22] Filed: Dec. 9, 1992

[30] Foreign Application Priority Data

Dec. 13, 1991 [FR] France ..... 91 15541

[51] Int. Cl.[6] ..... B05B 11/04

[52] U.S. Cl. ..... 141/18; 141/94; 141/309; 141/330; 141/363; 141/351; 141/366; 222/82; 222/321.8; 222/333; 222/504; 222/385; 222/541; 239/332

[58] Field of Search ..... 141/2, 3, 18–20, 141/21, 29, 94, 309, 329, 330, 363–366, 351–353; 222/81, 82, 321, 325, 333, 383, 385, 504, 541; 239/309, 331, 332, 333

[56] References Cited

U.S. PATENT DOCUMENTS

| | | | |
|---|---|---|---|
| 2,770,896 | 11/1956 | Holmberg | 239/332 |
| 2,802,696 | 8/1957 | Galeazzi | 222/82 |
| 3,127,060 | 3/1964 | Vosbikian et al. | 222/504 X |
| 3,521,794 | 7/1970 | Bijl | 222/333 |
| 3,666,144 | 5/1972 | Winder | 222/504 X |
| 3,970,121 | 7/1976 | Brandt | 141/2 |
| 4,025,046 | 5/1977 | Boris | 239/333 |
| 4,173,858 | 11/1979 | Cassia | 141/330 X |
| 4,457,455 | 7/1984 | Meshberg | 222/105 |
| 4,614,284 | 9/1986 | Miles | 222/541 X |
| 4,938,262 | 7/1990 | Williams et al. | 141/330 X |
| 5,221,025 | 6/1993 | Privas | 222/333 X |

FOREIGN PATENT DOCUMENTS

| | | | |
|---|---|---|---|
| 312474 | 4/1989 | European Pat. Off. . | |
| 447997 | 9/1991 | European Pat. Off. . | |
| 2510069 | 1/1983 | France . | |
| 0401060 | 12/1990 | France . | |
| 0497709 | 8/1992 | France . | |
| 2505493 | 8/1976 | Germany | 222/321 |
| 9114630 | 10/1991 | WIPO . | |

*Primary Examiner*—J. Casimer Jacyna

*Attorney, Agent, or Firm*—Sughrue, Mion, Zinn, Macpeak & Seas

[57] ABSTRACT

A rechargeable device for spraying a fluid in a mist-like manner. The device includes an actuator head and a removable tank containing the fluid. The actuator head includes an actuator member that is movable between a predetermined high position and a predetermined low position. The removable tank includes a neck in which a pump is engaged. The pump has a hollow pump body which defines a cylindrical pump chamber filled with the fluid and in which a piston slides. Extending from the piston is a hollow actuator rod through which the fluid leaves the pump. The pump chamber is in communication with the fluid contained in the tank. A pushbutton fitted with a lateral outlet nozzle is fixed to the actuator rod of the pump, such that the actuator member presses against the pushbutton to actuate the pump. The neck of the tank includes a removable plug on which the pump is fixed. The device further includes an angular positioning mechanism for positioning the lateral nozzle angularly relative to the actuator head, and an accurate axial positioning mechanism for positioning the pump at a predetermined position. The pump body is engaged in sealing contact with the neck of the tank to establish communication with the fluid contained in the tank.

37 Claims, 18 Drawing Sheets

FIG.12
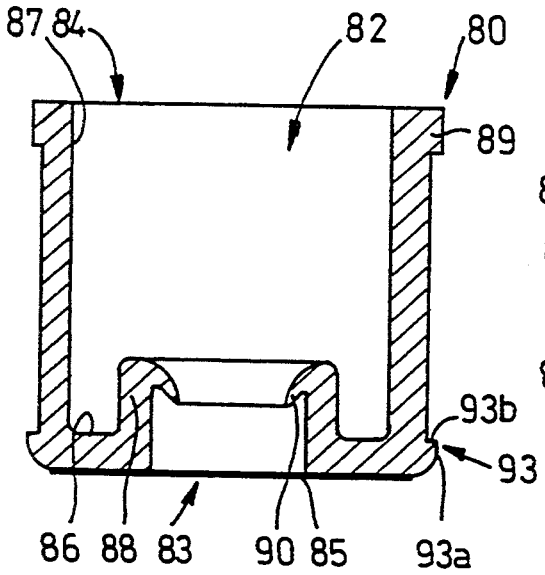
FIG.13
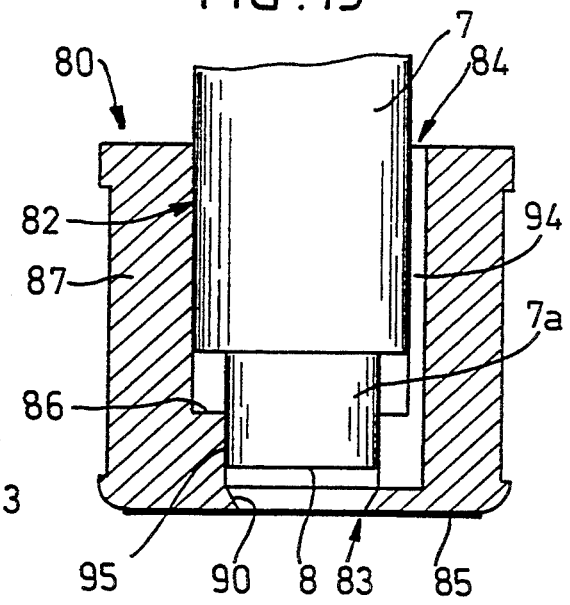
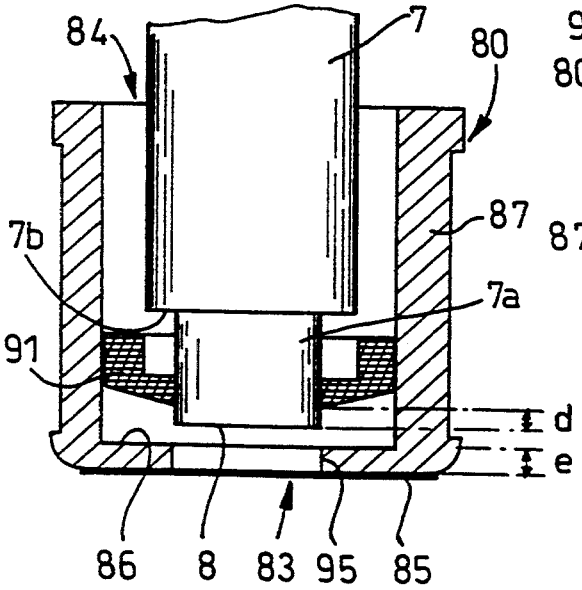
FIG.14
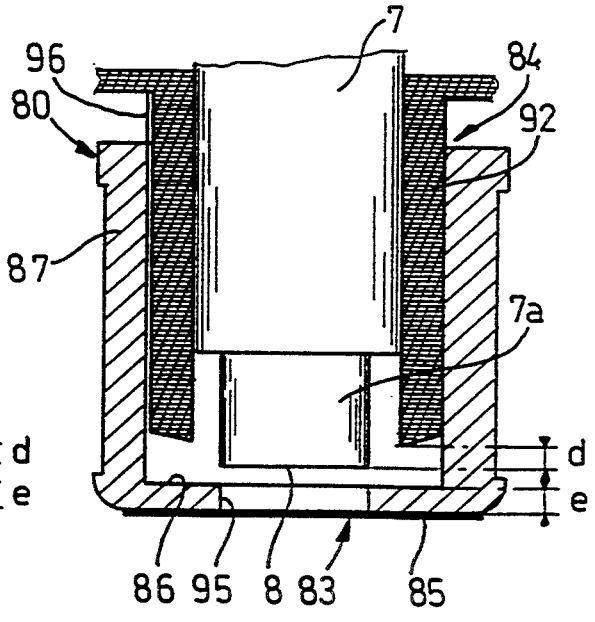
FIG.15

FIG. 20
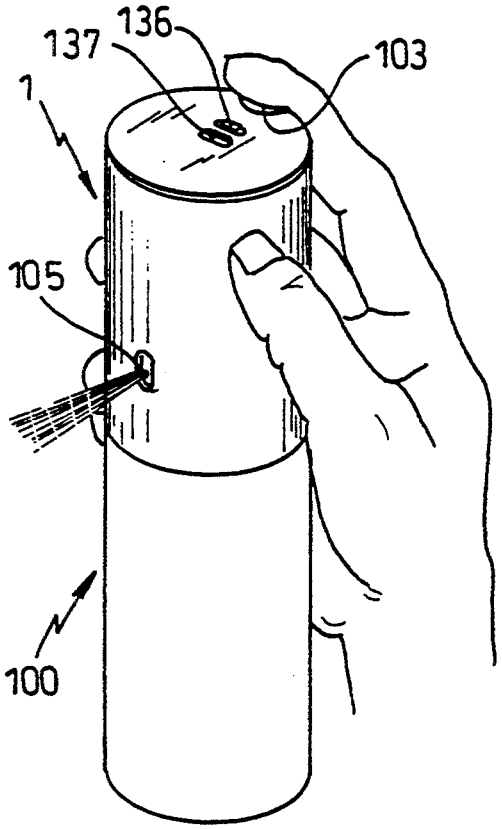
FIG. 21
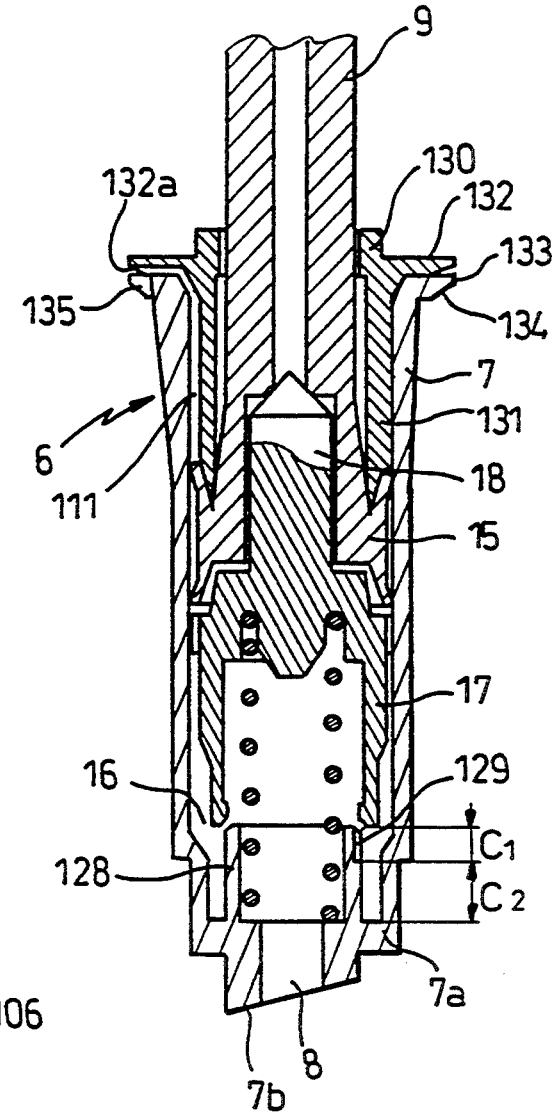
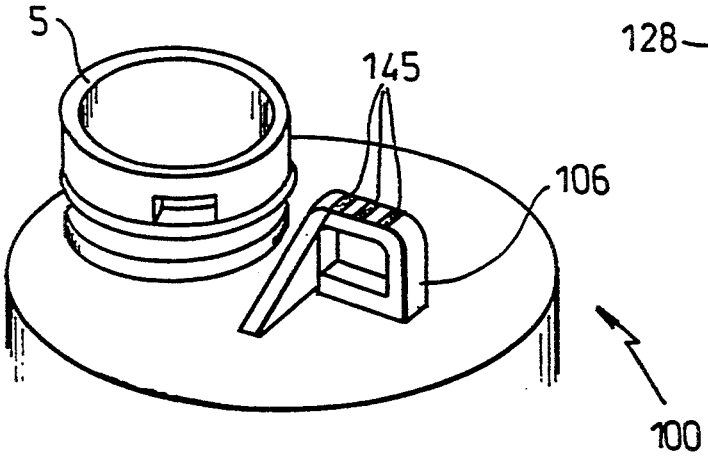
FIG. 40

FIG.23
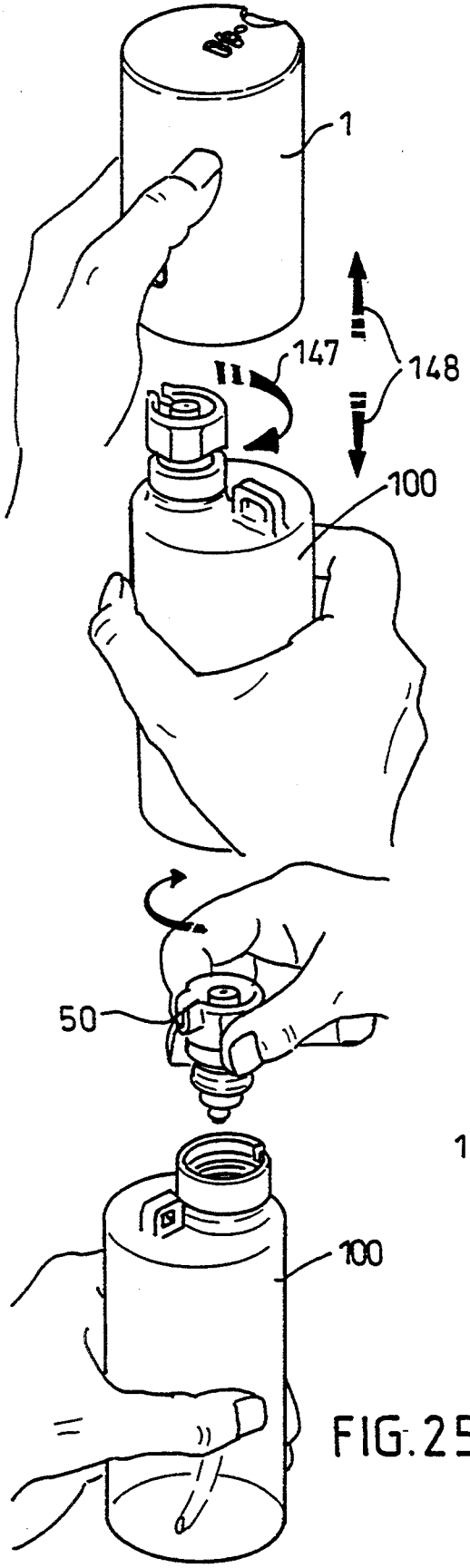
FIG.25
FIG.24
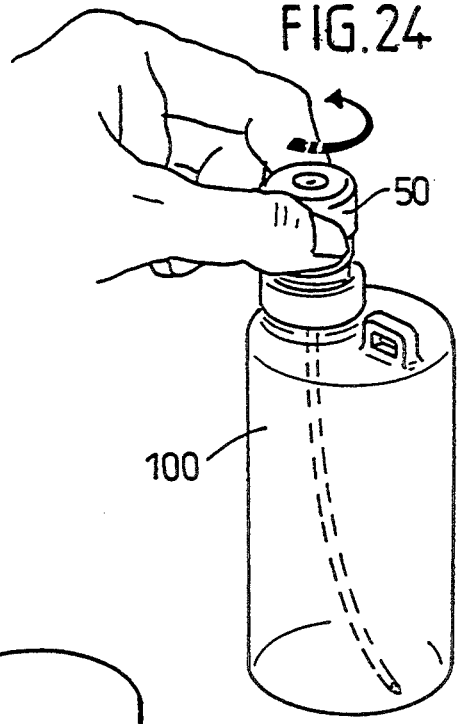
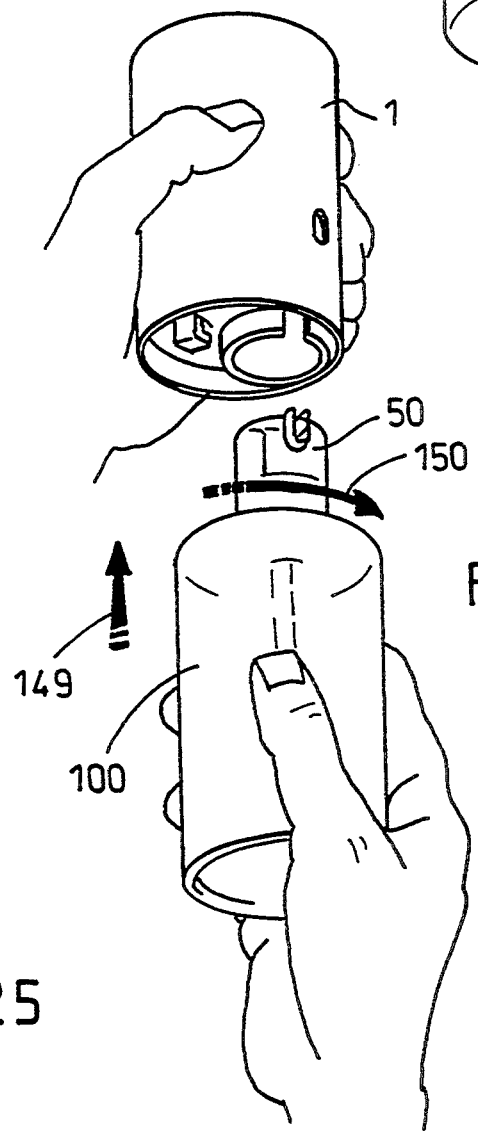
FIG.26

XXXII
XXXII
50
51
52
53
54
55
169
173
174
175
176
200
201

FIG.33
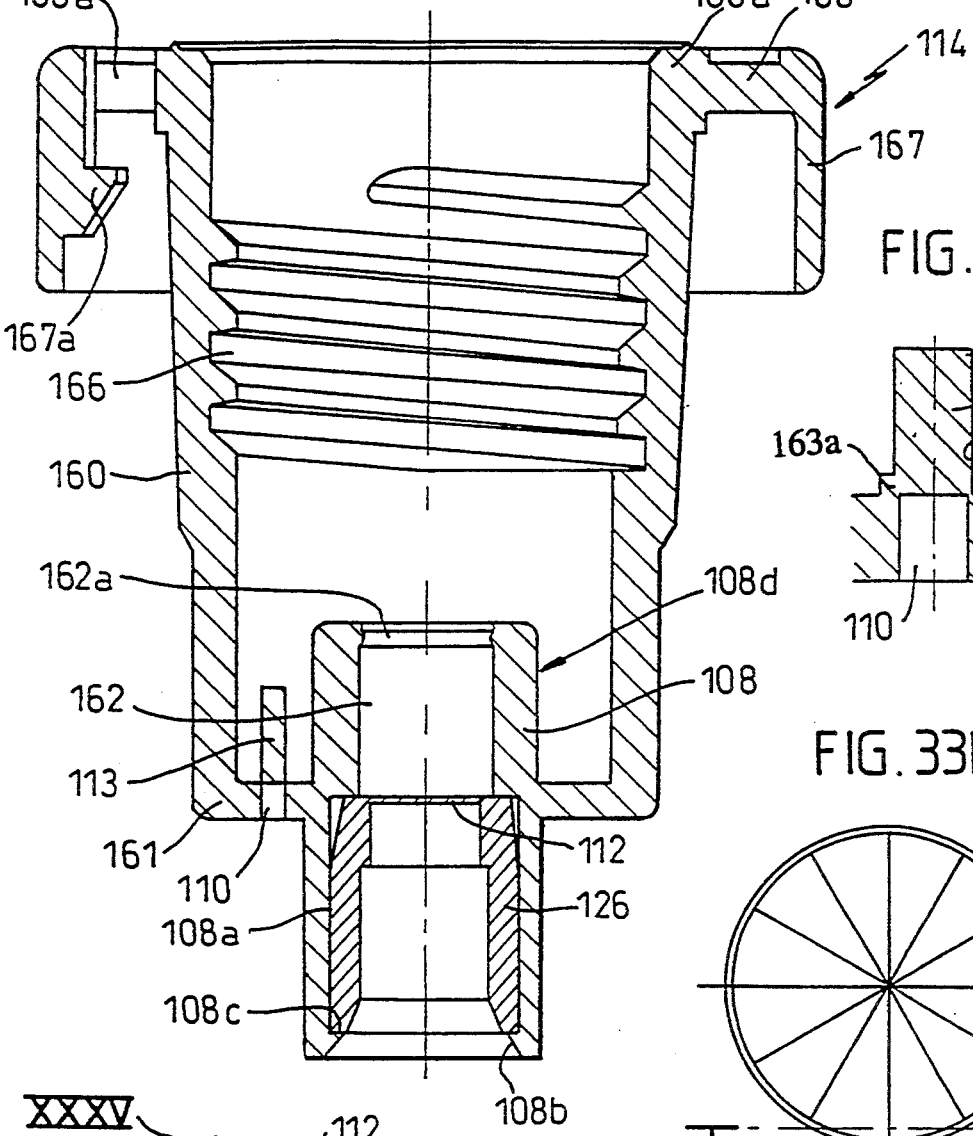
FIG.36
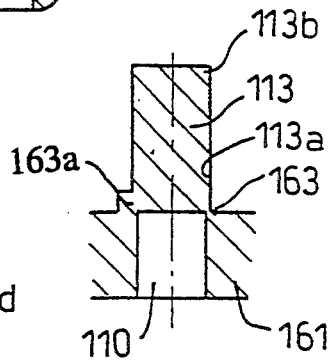
FIG.33b
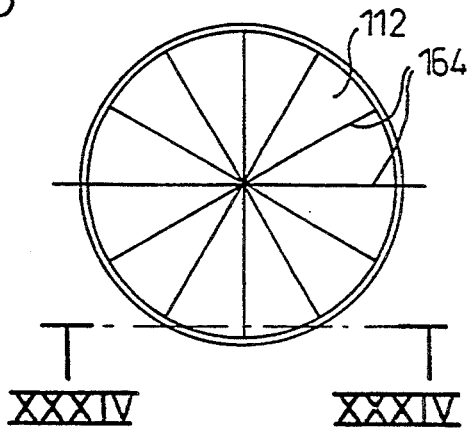
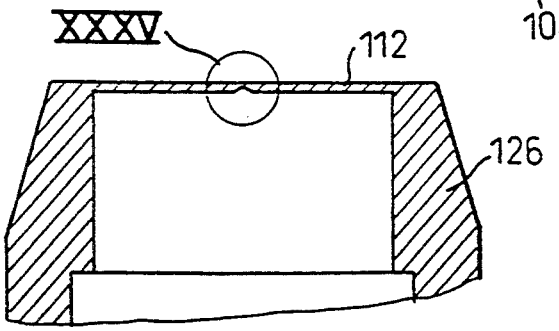
FIG.33a
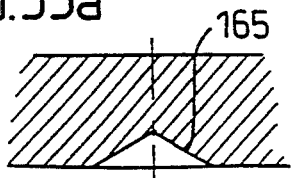
FIG.35
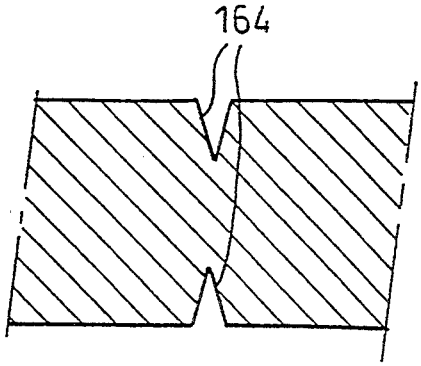
FIG.34

RECHARGEABLE DEVICE FOR SPRAYING A FLUID

The present invention relates to a rechargeable device for spraying a fluid.

BACKGROUND OF THE INVENTION

In particular, the invention relates to a device comprising a tank of fluid to be sprayed, a spray pump mounted on said tank, and an actuator head including automatic actuation means for actuating the pump. Document EP-A-0 401 060 discloses such a device. Because the actuator head is expensive, the device must be rechargeable, which means that the tank of fluid and the pump which is fixed thereon must be disassembled in order to refill the device. Although it is possible to replace both the empty tank and its pump simultaneously with a full tank having another pump mounted thereon, that adds the price of a new pump to the price of each refill, even though the pump mounted on the empty tank could still be used. For example, with tanks of standard size (e.g. 200 ml) and with an actuator head that actuates the pump 40 times per second, a conventional piston spray pump of the type normally actuated by hand and made of molded plastic can be used for emptying at least ten tanks. Replacing the pump each time the tank is replaced thus constitutes a pointless expense that considerably increases the cost of using the device.

An object of the present invention is thus to propose a device of the type mentioned above in which the spray pump can be reused on several successive tanks, while guaranteeing good reliability of operation, and without presenting the user with difficulties when disassembling the pump from an empty tank and reassembling it on a full tank.

In particular, when the pump is a piston type pump, the quantity of fluid expelled on each actuation depends on the stroke of the piston, and it may be small. Since the automatic pump actuator means include an actuator member which presses on the pushbutton of the pump in order to actuate the pump and which moves between a predetermined high position and a predetermined low position, another object of the invention is for the pump to be axially positioned with great accuracy relative to the head. For example, in a device that has been tested experimentally and in which the pump is actuated at 40 Hz, the stroke of the piston is about 2.47 mm.

SUMMARY OF THE INVENTION

The present invention thus provides a rechargeable device for spraying a fluid, the device comprising an actuator head and a removable tank containing said fluid, in which:

the actuator head includes an actuator member that is movable between a predetermined high position and a predetermined low position, said actuator head having means for displacing said actuator member between its high position and its low position;

the removable tank includes a neck in which a pump is engaged, said pump having a hollow pump body which defines a cylindrical pump chamber filled with said fluid and in which a piston slides, the piston being extended axially towards the outside of the pump body by a hollow actuator rod through which said fluid leaves the pump, said pump chamber being in communication with said fluid contained in the tank;

a pushbutton fitted with a lateral outlet nozzle is fixed to the actuator rod of the pump, and said actuator member presses against said pushbutton to actuate the pump; and the neck of the tank includes a removable plug on which the pump is fixed, the plug being removably fixed to the neck, the device further including angular positioning means for positioning said lateral nozzle angularly relative to the actuator head, and accurate axial positioning means for positioning the pump at a determined distance from said means for displacing the actuator member, and the pump body is engaged with sealing contact in the neck of the tank to establish said communication with said fluid contained in the tank.

In a first embodiment, the pump operates with intake of air, and includes a lateral air intake orifice, the neck of the tank including a central duct which is in communication with the fluid by means of a dip tube that extends into the tank, the pump body being sealingly engaged in said central duct, and the neck also including an air intake passage formed beside the central duct and causing the air intake orifice of the pump to communicate with the inside of the tank. The fact that the dip tube is fixed to the neck of the tank and not to the body of the pump as is usual, is advantageous for at least two reasons. Firstly, when the pump and plug assembly is moved from an empty tank which initially contained a first fluid and is put on a full tank containing a second fluid different from the first, the quantity of the first fluid which is taken with the pump is limited to no more than the volume of the pump chamber, which is generally very small: if the dip tube were mounted on the pump, then it might still contain the first fluid when being transferred to the full tank, and that would increase the time during which the device would spray a mixture of the two fluids. In addition, the fact that the neck of the tank communicates with the fluid via a dip tube rather than directly greatly reduces the possibility of the fraud in which the tank is partially emptied before being purchased by the consumer, and in practice it also avoids users refilling an empty tank with a fluid without having an appropriate refill, thereby limiting the chances of the device being used badly.

Advantageously, the central duct is provided with a frangible membrane which closes said central duct prior to the plug being installed, and which is then broken by the pump body when the plug is installed on the neck, and/or the air intake passage is provided with a frangible closure element which closes said air intake passage prior to said plug being installed, and which is broken while the plug is being installed on the neck. It is thus particularly difficult to empty a portion of the tank through its neck for the purpose of fraudulently reducing the quantity of fluid that is sold. In addition, when the central duct and the air intake passage are both closed prior to the plug being installed, the fluid contained in the tank is protected against pollution and against oxidization by the oxygen in the air, and the fluid may optionally be stored under a vacuum until the plug is installed on the neck. Said frangible element that closes the air intake passage may optionally have a projecting portion which interferes with the plug or with the body of the pump while said plug is being installed. In an advantageous variant, said plug is fixed on said neck by being screwed thereon, said frangible closure element is a rod that extends axially between a base and a free end, the base of said rod being connected to the neck by a peripheral bridge of frangible material, and the plug includes a member which extends axially towards the inside of the tank, to correspond with said rod, said member interfering with the free end of the rod by causing said rod to lie down when the plug is screwed onto the neck, thus at least partially breaking said peripheral bridge of frangible material.

Optionally, the neck includes a ring that is snap-fastened in non-reversible manner in said neck, and said ring includes said central duct and said air intake passage. The ring may be tapped internally and the plug may have an external thread, in which case the plug is screwed into the ring.

The invention also provides a refill for filing the tank of said device after it has been emptied by said pump, the refill comprising:

a deformable receptacle capable of being compressed by a user; and an endpiece having fixing means that are substantially identical to those of the plug to enable it to be removably fixed in the neck of the tank instead of the plug, said endpiece terminating in an outlet duct provided with an outlet channel that communicates with said deformable receptacle, and which is adapted to engage the central duct of the neck in sealed manner when said endpiece is fixed on said neck.

Advantageously, the device has a central duct provided with a projecting portion directed towards the pump body, said refill having an outlet duct closed by a plug capable of opening the outlet duct by being engaged in the outlet duct, said outlet duct of the refill being adapted to be engaged in sealed manner in said projection portion of the central duct of the tank, and said plug being adapted to come into abutment against said projecting portion during such engagement so as to open the outlet duct of the refill.

In a second embodiment of the invention, the pump operates without air intake, the tank is deformable, the neck includes a frangible membrane which closes said neck before the plug is fixed thereto and which is torn by the pump body while the plug is being fixed to the neck, and the neck includes sealing means which cooperate with complementary sealing means displaceable with the pump body to establish sealing between the neck and the pump body no later when the pump body breaks said frangible membrane.

Advantageously, the neck includes a central duct which extends axially between a first end and a second end, the duct including peripheral internal relief constituting said sealing means, and said frangible membrane is disposed between said inside relief and the first end of said central duct. Said peripheral inside relief may advantageously be formed in the vicinity of the frangible membrane. The said peripheral inside relief may include an annular lip formed inside the duct and adapted to bear radially in sealed manner against the pump body. In another variant, said sealing means of the duct include a shoulder formed in the duct between the frangible membrane and the second end thereof, said shoulder facing towards said second end, said shoulder being adapted to provide sealing in association with an annular gasket when said annular gasket comes into abutment against the shoulder, said annular gasket being slidably mounted with friction and with sealing engagement on the pump body and sliding without lateral sealing relative to the duct.

In a variant, the neck is formed at the top of the tank. Advantageously, in this variant, the tank includes at least one deformable wall, said deformable wall being adapted to move between a first position in which the tank defines a maximum inside volume and a second position in which the tank defines substantially zero inside volume, and it further includes resilient means which urge said deformable wall towards its second position with sufficient force to establish pressure in the vicinity of the neck greater than the vaporization pressure of said fluid at ambient temperature, regardless of the position of said deformable wall. The pressure may be at least atmospheric pressure or it may be at least 20 kPa greater than atmospheric pressure. The deformable wall may include a rigid bottom and a flexible side wall, said resilient means urging the rigid bottom towards the neck, and when the volume of fluid contained in the tank diminishes, the bottom of the deformable wall moves towards the neck, progressively folding said flexible side wall over onto itself. The rigid bottom may be thick so as to guide its own upwards movement towards the neck. The tank may be placed in a rigid case that is substantially complementary in shape to the side wall of said tank. In a variant, said neck includes a ring snap-fastened in non-reversible manner in said neck, and said ring includes the frangible membrane and the sealing means. Advantageously, said plug includes air-passing means for allowing the air compressed between said plug and said sealing means of the neck to escape to the atmosphere when the plug is installed on the neck.

Advantageously, in both embodiments of the invention, the tank includes a peripheral side wall that is not circularly symmetrical relative to said neck, a portion of said neck lying in the vicinity of the side wall, and the lateral nozzle of the pushbutton points towards said portion of the neck adjacent to the side wall: the length of the lateral nozzle of the pump pushbutton is thus reduced.

Advantageously, said plug is fixed in a ring engaged in the neck of the tank, the neck has an inside surface that is slightly flared, becoming larger towards the outside of the tank, and the ring has a complementary tapering surface that rests against the flared inside surface of the neck to damp vibration. The tank is advantageously made of low density polyethylene, thereby making it sufficiently flexible to absorb the vibration due to the pump being actuated.

Advantageously, in both embodiments of the invention, the plug includes a first portion close to the tank and having an outside shape which is circularly symmetrical about the axis of the actuator member, and a second portion at a distance from the tank-and having an outside shape which is not circularly symmetrical, the head including a latching wall substantially perpendicular to the axis of the actuator member, said latching wall having a recess of a shape that is substantially complementary to the outside shape of the first portion of the plug, said recess being centered relative to the actuator member of the actuator head, the pushbutton is engaged in removable manner on the actuator member when the plug is axially engaged in said recess, and the plug is locked on said latching wall by rotating the tank and the plug about the axis of the actuator member, the tank further including a loop close to the actuator head and extending radially relative to the axis of the actuator member, and said actuator head including a hook extending orthogonally to a radius so as to hook onto the loop at the end of said rotary movement of the tank and of the plug.

Advantageously, in both embodiments of the invention, the tank includes means for carrying coded information, so as to enable coded information to be written on said tank, and said electronic circuit for control and power supply purposes includes reader means for reading said coded information, said reader means being connected to control means for enabling or disabling operation of the actuator head as a function of said information as read.

Advantageously, in both embodiments of the invention, said angular positioning means for said lateral nozzle include means for imposing a given orientation on the plug relative to the head, and guide means for guiding the lateral nozzle of the pushbutton in a plane having a particular orientation relative to the plug. In particular, the plug may include snap-fastening relief that snaps into the actuator head, thereby fixing the angular position of the plug.

Advantageously, in both embodiments of the invention, said angular positioning means for said lateral nozzle comprise relief formed in complementary manner on said ring and said neck to cause said ring to take up a determined angular orientation relative to the tank, the threads on said ring and on said plug co-operating to give the plug a determined angular orientation relative to said ring, said angular positioning means further including means for constraining the tank to take up a determined orientation relative to the head, and guide means for guiding the lateral nozzle of the pushbutton in a plane that has a particular orientation relative to the plug. Optionally, the ring and the plug further include complementary snap-fastening relief for making the plug take up an accurate angular orientation relative to the ring.

In both of the above-specified embodiments, the invention also provides a refill constituted by a tank filled with fluid, and optionally provided with a snap-fastening ring in its neck.

BRIEF DESCRIPTION OF THE DRAWINGS

Embodiments of the invention are described by way of example with reference to the accompanying drawings, in which:

FIGS. 12 to 15 are longitudinal section views of different rings that can be installed in the necks of the tanks of FIGS. 4 and 9;

FIG. 20 is a perspective view of a device constituting a second embodiment of the invention;

FIG. 21 is a section view through an example of a pump suitable for use in the FIG. 20 device;

FIGS. 23 to 26 show the tank of the FIG. 20 device being changed;

FIG. 33 is a section view through a snap-fastening ring in the neck of the tank of the FIG. 20 device;

FIG. 33*a* is a detail view of the frangible membrane of the FIG. 33 ring;

FIG. 33*b* is a plan view of the FIG. 33*a* membrane;

FIG. 34 is a section view on line XXXIV—XXXIV of FIG. 33*b;*

FIG. 35 is a view of a detail XXXV of FIG. 33*a;*

FIG. 36 is a detail view of the FIG. 33 ring;

FIG. 40 is a detail view of the top of the tank of the FIG. 20 device.

DETAILED DESCRIPTION

The embodiments described below all relate to a device of the general type described in European patent application EP 0 401 060, in which a piston spray pump of the type that is normally hand actuated is connected to a tank of fluid and is actuated by means of a core that may be made of soft iron, and that is associated with a solenoid.

The tank contains a fluid that is liquid or semi-liquid and that may be a perfume, a pharmaceutical or a cosmetic, hair lacquer, an insecticide, paint, a cleaning fluid, etc. Such a device can be actuated either stroke-by-stroke or else at a rapid repetition rate, e.g. at 40 Hz, thereby causing the fluid to be sprayed or dispensed in a manner that is pseudo-continuous. The result obtained in this way is similar to that which would be obtained when using a propellant gas: such a device can therefore avoid the use of propellant gases such as chlorofluorocarbons which are known to have environmentally-damaging effects, or hydrocarbons which are dangerous for users.

First embodiment

In a first embodiment as shown in FIGS. 1 to 19, the pump of the device of the invention can operate without an air intake, i.e. without admitting air into the tank each time the pump is actuated.

Figure 1:
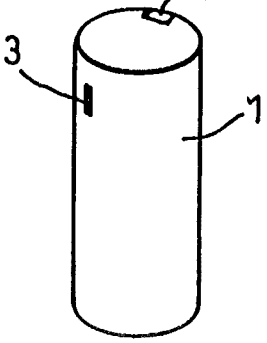
FIG. 1 is a diagrammatic perspective view of a device constituting a first embodiment of the invention.

With reference to FIG. 1, the device of the invention may be integrated in an elongate box 1 designed to be held vertically in the hand of the user. The box 1 includes at least one actuator button 2 and an outlet orifice 3 enabling the fluid to be expelled in spray or other form. The box 1 includes an actuator head which contains the core and its solenoid; and which may include batteries (rechargeable or otherwise) or which may be connected to mains electricity.

Figure 3:
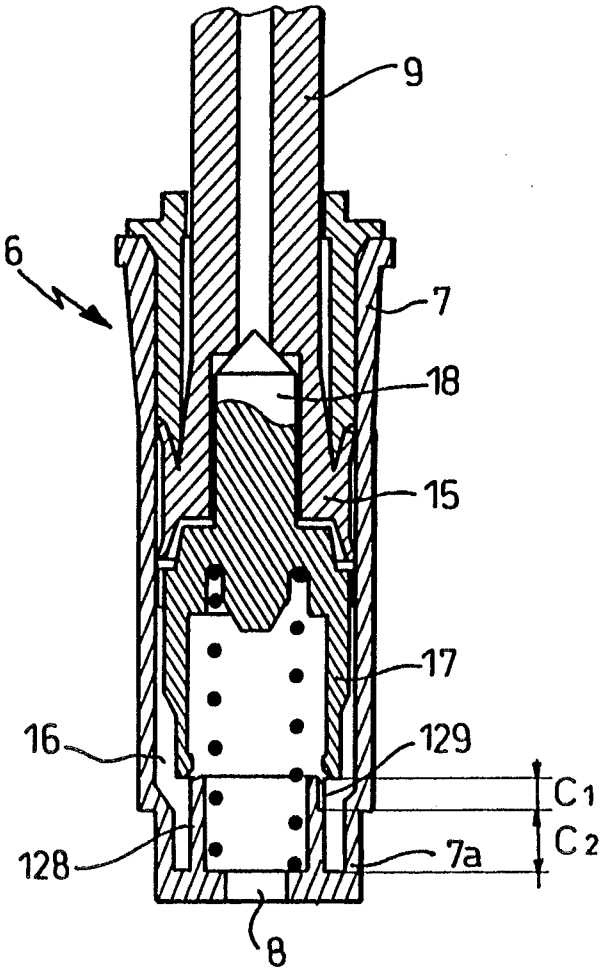
FIG. 3 is a section view through an example of a pump suitable for use in the FIG. 1 device.
Figure 2:
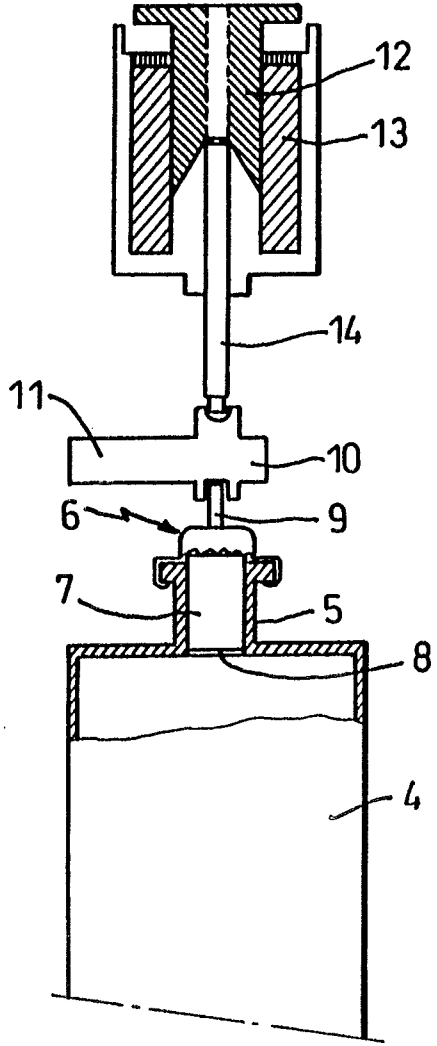
FIG. 2 is a section through one embodiment of the actuator means for the FIG. 1 device.

FIG. 2 is a diagram showing the inside of the box 1 of FIG. 1. The device comprises a tank 4 containing the fluid to be sprayed or to be dispensed without being sprayed. The top of the tank 4 has a neck 5 in which a pump 6 is mounted. An example of the pump 6 is shown in FIG. 3, which example comprises a pump body 7 having an optionally narrowed inlet end 7*a*. The inlet end 7*a* includes an admission orifice 8 which communicates with the tank 4. The pump also includes a hollow actuator rod 9 which serves as an outlet for the fluid. A pushbutton 10 is mounted on the actuator rod 9 of the pump and includes a lateral nozzle 11 for expelling the fluid to the outside of the device. The device also includes actuator means comprising a core 12 of magnetic material such as soft iron slidably mounted with lost motion in a solenoid 13 and connected to a rod 14 which is preferably non-magnetic and which is adapted to press against the pushbutton 10 when the solenoid 13 is activated. The rod 14 is preferably connected to the pushbutton 10 and it is in axial alignment with the hollow actuator rod 9. The rod 14 is preferably removably snap-fastened on the pushbutton 10, and the pushbutton 10 is more securely fixed to the hollow actuator rod 9 than to the rod 14, such that the pushbutton 10 stays with the pump 6 when axial tension is applied. The rod 14 is preferably circularly symmetrical. The actuator mechanism of the pump is shown in greater detail in FIGS. 27 and 28 which are described below with respect to the second embodiment.

The pump 6 may be of the type described in French patents FR 2 305 241 and FR 2 314 772 and in corresponding American patent U.S. Pat. No. 4,025,046, and an example of the pump is shown in FIG. 3. Such a pump comprises a hollow cylindrical pump body 7 slidably receiving a piston 15 connected to the actuator rod 9. The pump body and the piston together define a pump chamber 16 which communicates with the admission orifice 8 via an inlet valve 17 constituted in this case by a skirt that fits over a tubular endpiece 128 formed around the admission orifice. The pump chamber 16 also communicates with the outside via an outlet valve 19 constituted in this case by a punch 18 resiliently urged against a seat formed in the rod 9. The pump described briefly above and described in detail in the above-mentioned patents is given purely by way of non-limiting example. Other pumps could be used, for example the pump described in European patent application EP 0 330 530 and in American patent U.S. Pat. No. 4 936 492.

It is preferable for the skirt 17 to be a sealing fit over the endpiece 128 only after it has moved along a dead stroke C1 that is advantageously 0.5 to 2 times the working stroke C2 of the piston during which the piston expells the fluid contained in the pump chamber: thus, the core 12 accelerates along the stroke C1 before it begins to apply pressure to the fluid contained in the pump chamber, thereby ensuring that it has sufficient kinetic energy to produce a uniform spray of fine particles from the beginning to the end of the working stroke C2 of the piston. For example, the endpiece 128 may include an axial groove 129 in its top end, which groove extends a certain distance towards the admission orifice 8.

When the rod 14 is not attached to the pushbutton 10, the rod 14 may be moved through a certain axial distance C1 away from the pushbutton so that the core 12 can travel along a certain dead stroke C1 before making contact with the push-button. Under such circumstances, the groove 129 is pointless. In any event, it is essential that the pump body 7 is very accurately positioned axially relative to the solenoid 13 in order to guarantee the strokes C1 and C2 (dead stroke and working stroke).

Figure 4:
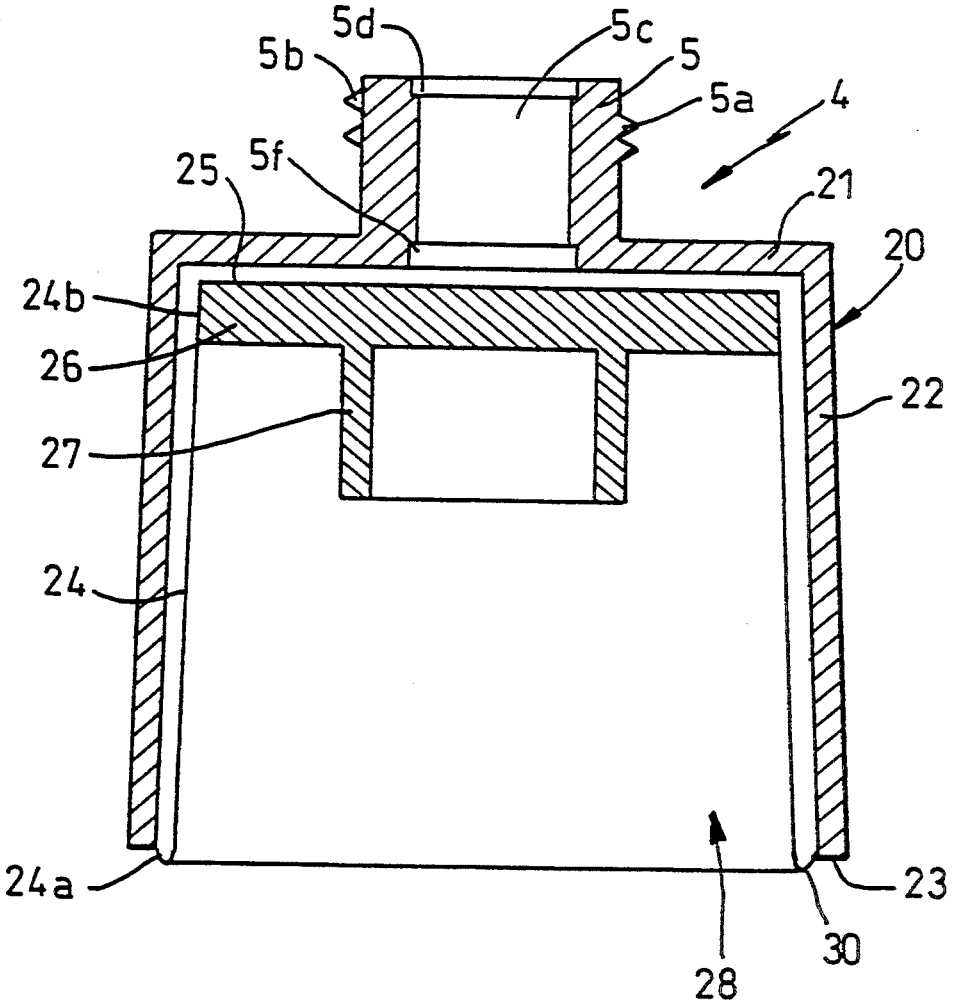
FIG. 4 is a section view through the tank of the FIG. 1 device, prior to filling.

FIG. 4 shows a first embodiment of the deformable tank 4 of the device of the invention prior to filling. The tank 4 includes a relatively rigid top portion 20 in which the neck 5 of said tank is formed. The neck 5 includes an outside thread 5*a* having an axial groove 5*b* for a purpose explained below when describing FIGS. 11 to 15. A central opening 5*c* passes through the neck 5 running from a top enlarged portion 5*d* forming a shoulder that faces upwards to a bottom enlarged portion 5*f* forming a shoulder that faces downwards. The purpose of these enlarged portions is also described below with reference to FIGS. 11 to 15. A rigid annular wall 21 extends radially outwards from said neck 5, said wall 21 being extended downwards by a rigid side wall 22 which extends to a bottom end 23. The wall 22 is advantageously slightly flared, being larger at its bottom end 23 than at the annular wall 21. Alternatively the wall 22 may be cylindrical, having a section that is circular or otherwise. The thickness of the wall 22 may be constant or it may decrease going from the annular wall 21 towards its bottom end. The bottom end 23 of the side wall 22 is extended by a thinner flexible side wall 24 which extends to a bottom 25 that may also be flexible. The flexible side wall 24 may taper slightly so that its diameter at the bottom 25 is substantially equal to or slightly smaller than the inside diameter of the rigid side wall 22 where it meets the annular wall 21. In this way, the wall 24 and the bottom 25 form a relatively flexible portion 28 of the tank which is suitable for being received inside the rigid portion 20 until the inside volume of the tank 4 has been reduced substantially to zero.

The tank 4 is generally made of synthetic material, e.g. out of elastomer or thermoplastic material, or of a mixture thereof. The flexible portion 28 may be added to the rigid portion 20. Alternatively, these two portions may be formed integrally as a single piece, e.g. by blow extrusion or by blow injection using two components with a layer of relatively stiff thermoplastic material being superposed on a layer of relatively flexible thermoplastic material in the rigid portion 20 of the tank.

A relatively thick and rigid guide disk 26 that is cylindrical or that tapers slightly is installed outside the bottom 25 when the tank 4 is in its folded position. The bottom face of the guide disk 26 may include an abutment projection 27 that extends a certain distance downwards.

Figure 5:
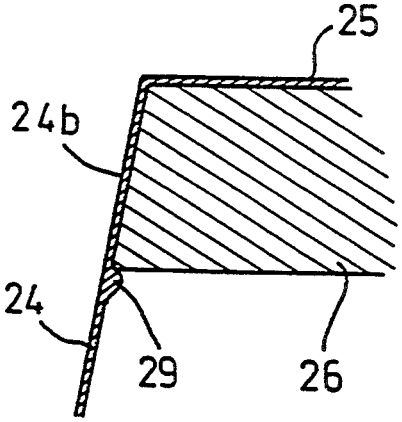
FIG. 5 is a detail view of FIG. 4.

The guide disk 26 may be kept in contact with the bottom 25 by clamping a portion 24*b* of the flexible side wall 24 which is folded over towards the top wall 21. In addition, as shown in FIG. 5, the flexible side wall 24 may include an annular rib 29 on its outside face that assists in keeping the guide disk 26 in place. However, the guide disk 26 could be kept in contact with the bottom 25 by any other means, and it could be disposed on the inside face of said bottom 25 without going beyond the ambit of the present invention, even though that solution is less preferred.

Figure 6:
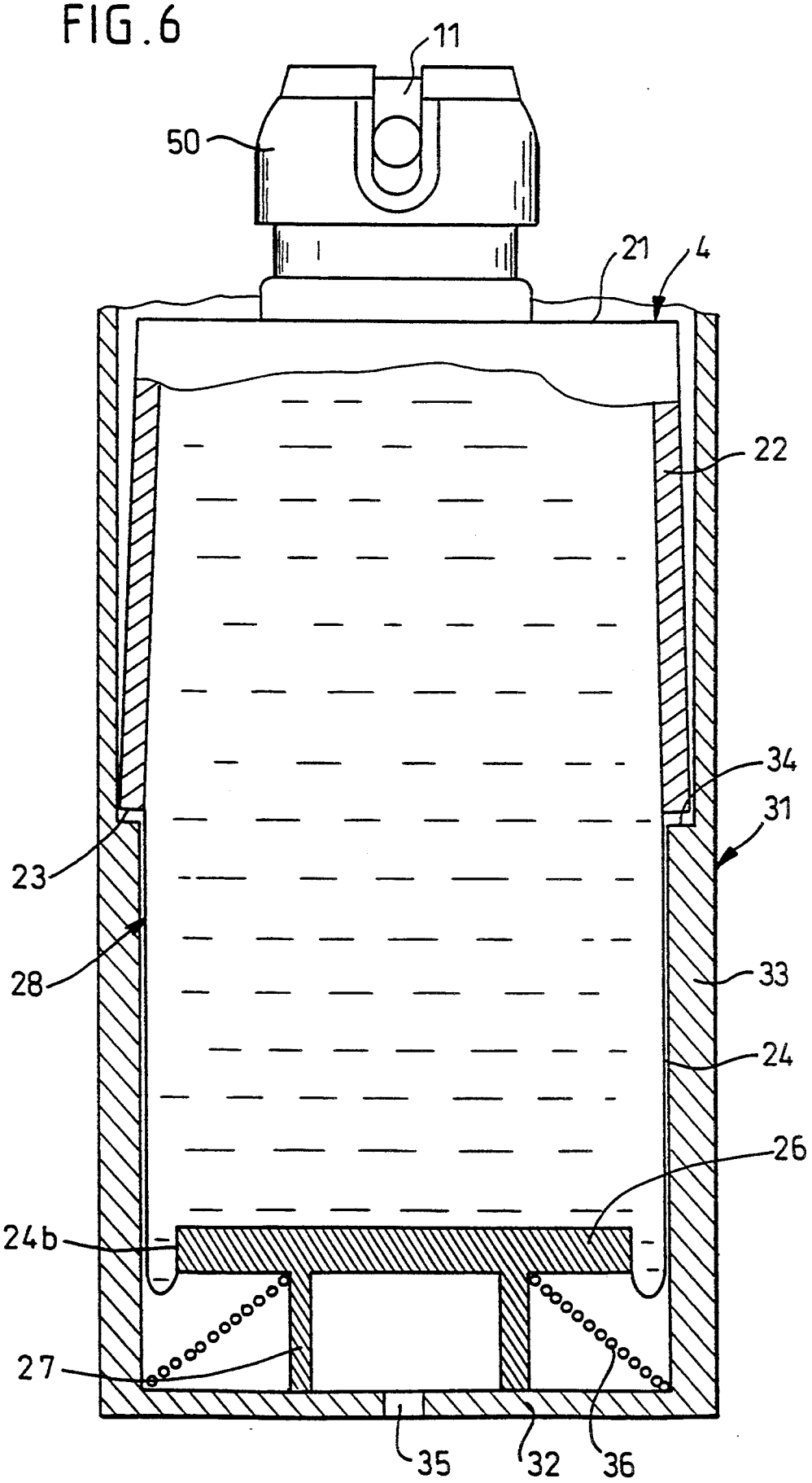
FIG. 6 is a section view through the FIG. 4 tank after filling and after it has been installed in the device of FIG. 1.

The tank 4 is filled under pressure with the fluid to be sprayed or dispensed, thereby partially unfolding said tank 4 until it reaches the position shown in FIG. 6 where only the portion 24*b* of the side wall 24 that surrounds the guide disk 26 is folded inwards. The flexible side wall 24 of the tank thus always has an annular fold 30 which constitutes the bottom end of the tank. Filling may be performed by injecting the fluid under pressure or by applying suction to the outside of the tank 4, or else the tank may move merely under the weight of the fluid.

The tank 4 is then placed in a vacuum chamber in which a vacuum is established so that the tank 4 no longer contains any air, after which the neck 5 is closed by means of a tearable-membrane ring such as that shown in FIGS. 11 to 15.

Thereafter, immediately before the tank 4 is used, a pump is installed in the neck 5, thereby tearing said tearable membrane, in a manner explained below with reference to FIGS. 11 to 15. The pump may be installed in a fixing plug 50 that is screwed to the neck 5. The fixing plug 50 may be made of molded plastic.

Figure 7:
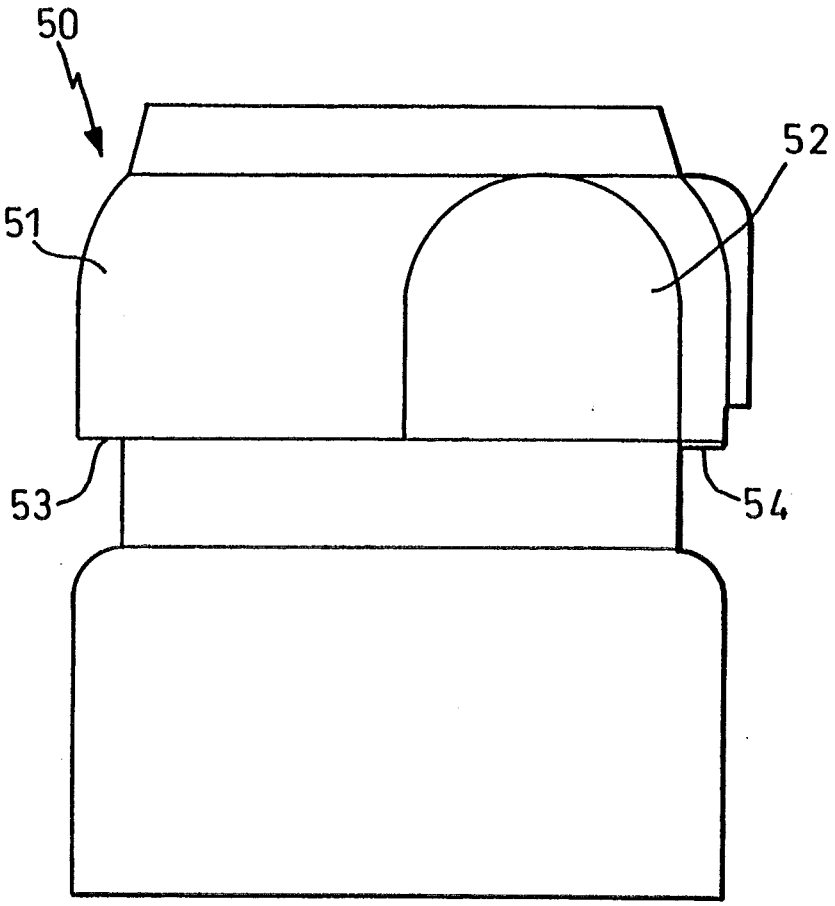
FIGS. 7 and 8 are respectively a side elevation view and a front elevation view of the plug of the FIG. 4 tank.
Figure 8:
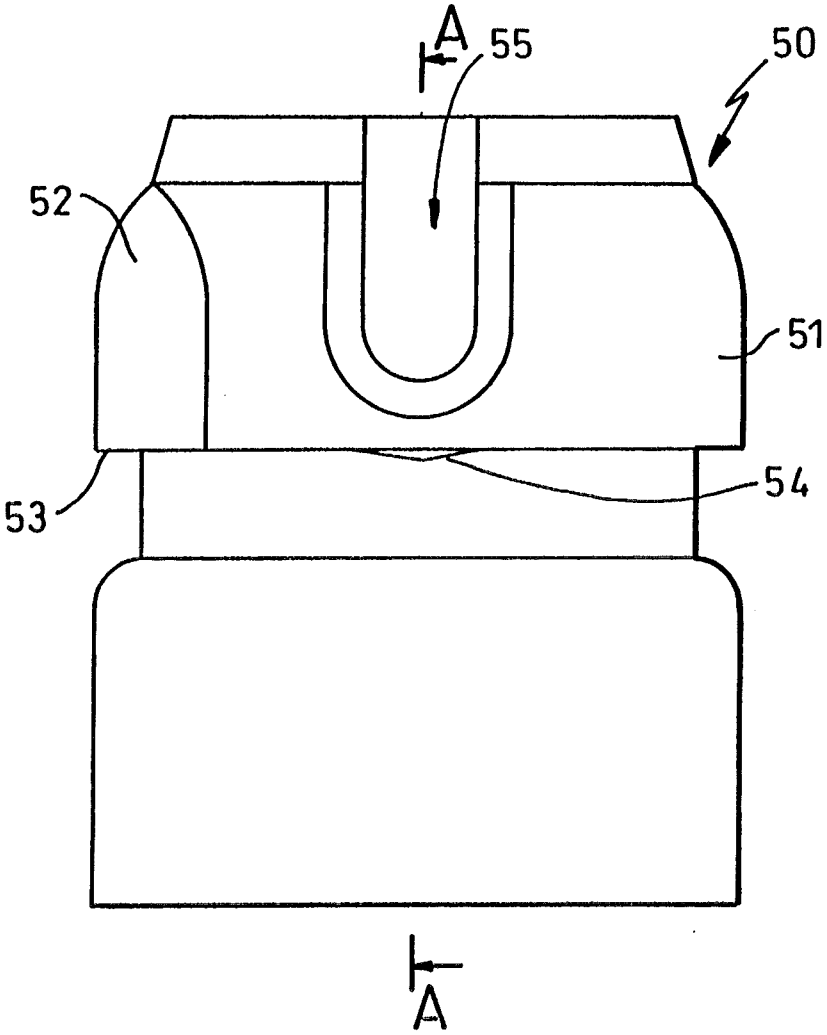
Figure 8A:
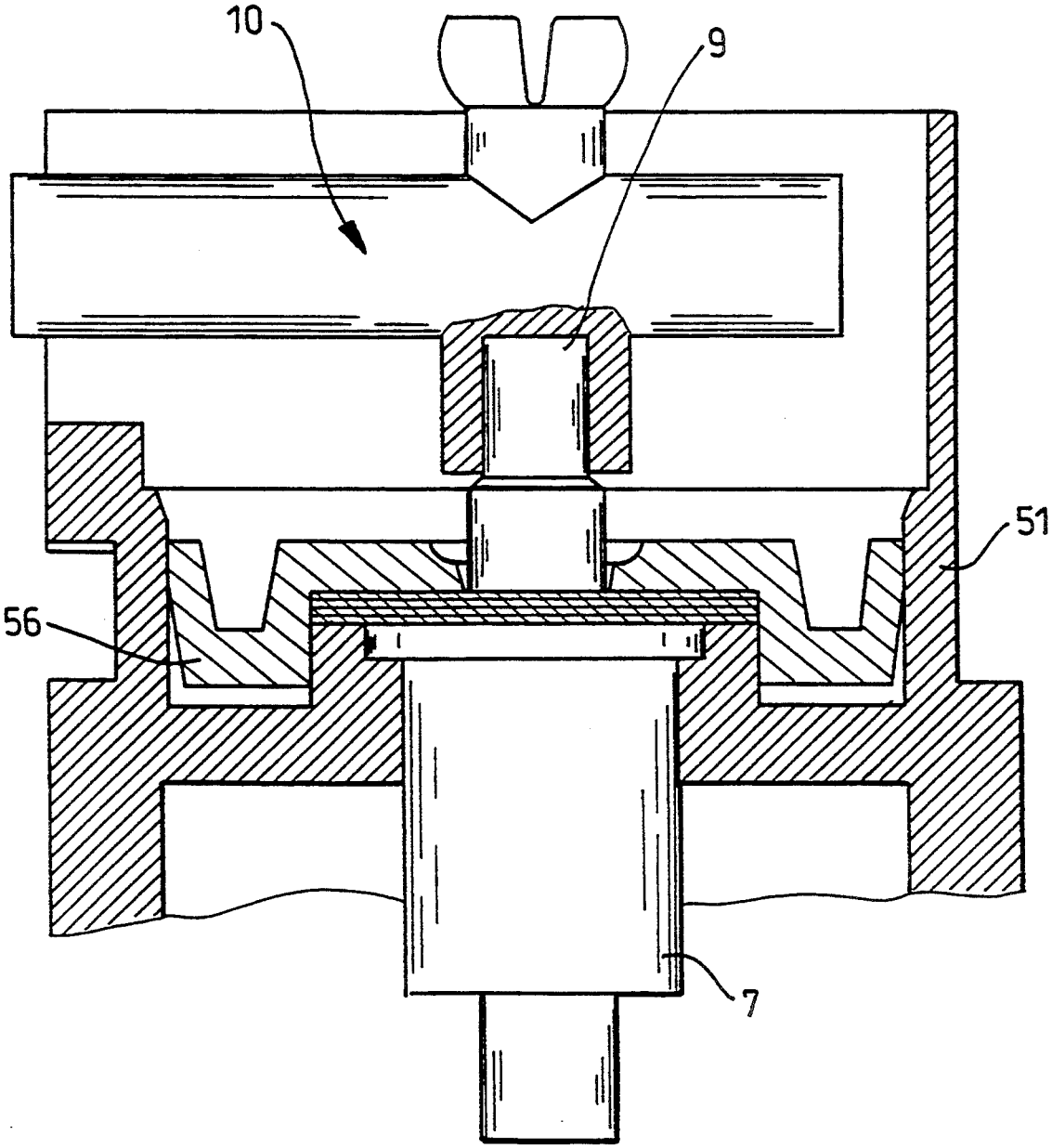
FIG. 8*a* is a section view on line A—A of FIG. 8, the pump being mounted on the plug.

As shown in FIGS. 7, 8, and 8*a*, the fixing plug 50 comprises a hollow cap 51 provided with at least one outside lateral flat 52, e.g. three flats 52 disposed at 120° from one another. The cap 51 defines an annular shoulder 53 facing the tank 4 and said shoulder 53 includes a rounded projection 54, likewise facing the tank. The plug 50 may receive a pump 7 fixed by any known means, e.g. by means of a washer 56 made of plastic and constituting a force-fit inside the cap 51, or else the plug 50 may possibly itself directly constitute the body of said pump. The cap 51 may include a notch 55 for passing the lateral nozzle of the pump-actuating pushbutton and for guiding said lateral nozzle 11 in a vertical plane. The plug 50 may be fixed in the box 1 by inserting the cap 51 into an orifice that is complementary in shape, and then by rotating the cap 51 so as to achieve locking by the projection 54 snapping into complementary shape in the box. The plug 50 is fixed in the box 1 so as to ensure that the pump body is positioned very accurately in an axial direction along the axis of the core 12, and so as to ensure that the lateral nozzle 11 is angularly positioned so as to face the orifice 3 formed in the box.

The lateral nozzle is positioned angularly by snap-fastening between the projection 54 on the plug 50 and by the notch 55 in the plug. This angular positioning ensures that the nozzle 11 is always facing the outlet orifice 3 of the box. The accurate axial positioning of the pump body is achieved by accurate axial positioning of the plug 50 and is explained in greater detail with respect to the second embodiment of the invention (FIG. 20 et seq). Since the core 12 is displaceable between a predetermined high position and a predetermined low position, it is essential for the pump body 7 to be accurately positioned axially relative to the solenoid 13, firstly in order to guarantee that the pump piston has a determined stroke and thus that a constant volume of fluid is expelled on each actuator thereof, and secondly to guarantee a determined acceleration distance C1 for the core prior to applying pressure inside the pump chamber, said acceleration distance being essential for guaranteeing good uniformity of the particles in the sprayed fluid. The tank 4 may also include a loop that is engaged by a hook on the box 1, as described below with reference to the second embodiment.

As shown in FIG. 6, the tank 4 is received in a rigid case 31 that forms a portion of the box 1 and that includes a bottom 32 from which a side wall 33 extends vertically upwards. The side wall 33 may be cylindrical, being circular or otherwise in section. The bottom 32 of the rigid case may include an orifice 35 for admitting air, and a spring 36 that extends from said bottom 32 towards the guide disk 26 of the tank 4. Advantageously, the spring 36 is a conical spring having a bottom end whose diameter is substantially equal to the inside diameter of the side wall 33 (assuming that the side wall 33 is circularly cylindrical). It is then advantageous for the abutment projection 26 on the guide disk 27 to have an outside shape that is circularly cylindrical and for the spring 36 to have a top end whose diameter is substantially equal to the outside diameter of said abutment projection 27. Thus, when the tank 4 is put into place inside the case 31, the abutment projection 27 is initially placed inside the top end of the spring 36, and then the assembly is slid into the case 31, with the spring 36 serving to guide such insertion. The side wall 33 of the case 31 advantageously includes an inside shoulder 34 that faces upwards and on which the bottom end 23 of the rigid side wall 22 of the tank 4 comes into abutment.

As the pump 6 is actuated, it sucks up fluid from the tank 4 and the bottom 25 of the tank 4 moves up towards the rigid top wall 21, progressively folding the flexible side wall 24 over itself, i.e. rolling up the side wall 24. Because of its thickness, the guide disk 26 has the effect during this movement of keeping the bottom 25 horizontal. The diameter of the guide disk 26 is substantially less than the diameter of the side wall 33 of the case 31, and is also less than the diameter of the rigid wall 22 of the tank 4, except level with the annular wall 21. Thus, as the bottom 25 moves up, the portion 24*b* of the side wall 24 that surrounds the disk 26 never rubs against the side wall 24 or against the side wall 22. Consequently, the upwards movement of the bottom 25 is not hindered in any way, thereby minimizing any tendency towards suction being established inside the tank 4. Furthermore, the spring 36 urges the guide disk 26 upwards, thereby establishing excess pressure inside the tank 4. The absolute pressure inside the tank 4 in the vicinity of its top annular wall 21 is thus always greater than the spraying pressure of the fluid contained in the tank or greater than the spraying pressure of the components of said fluid. Advantageously, the pressure inside the tank in the vicinity of its annular top wall 21 is always at least equal to atmospheric pressure, and more advantageously is always at least 20 kPa (about 200 grams per $cm^2$) greater than atmospheric pressure, regardless of the position of the bottom 25 inside the tank 4. Thus, at ambient temperature, the fluids contained in the tank 4 which may contain alcohol and/or water remain liquid or semi-liquid and as a result there is no danger of an air pocket forming in the vicinity of the admission orifice 8 to the pump. It may be observed that using the spring 26 to compress the liquid contained in the tank is particularly advantageous. The absolute pressure inside the tank 4 in the vicinity of its annular top wall 21 is substantially equal to:

$$P=F/S-\rho gh$$

where:

F is the thrust from the spring 36;

S is the section of the bottom 25 of the tank 4;

$\rho$ is the density of the fluid;

g is the acceleration due to gravity ($g=9.81$ m/s$^2$); and h is the depth of fluid contained inside the tank above the bottom 25.

Thus, as the fluid contained in the tank 4 is used up, and the bottom 25 moves up towards the annular top wall 21, the thrust F from the spring 36 decreases since the compression of the spring decreases, however the depth h of the fluid also decreases and as a result the pressure P does not vary very quickly.

Another advantageous characteristic of the invention results from the fact that it is easier to fold the tank 4 (i.e. to raise the bottom 25 towards the annular wall 21) than it is to unfold it (i.e. to move the bottom 25 downwards). This is because it is easier to entrain the flexible side wall 24 by pulling it, as occurs when the bottom 25 moves up inside the tank 4, than by pushing it as occurs when the bottom 25 moves down inside the tank 4. When the bottom 25 moves down inside the tank 4, folds occur in the portion of the wall 24 that has been moved up inside the tank 4, and these folds interfere with the downwards motion of the bottom 25. Thus, if the temperature of the fluid contained in the tank 4 increases abnormally, e.g. because the device has been left in the sun, it can happen that the thrust from the spring 36 is insufficient for preventing the beginning of gas pocket formation. The formation of gas in this way causes the pressure inside the tank 4 to increase, but because the bottom 25 tends not to move down under the effect of such pressure, the tank 4 can then be assumed to be substantially undeformable, so that the pressure inside the tank 4 increases very quickly and thus becomes sufficient to prevent more gas being formed at the temperature in question. As a result, the quantity of gas produced inside the tank 4 is very small even when the temperature is high, and any danger of the pump becoming unprimed is thus avoided.

Figure 9:
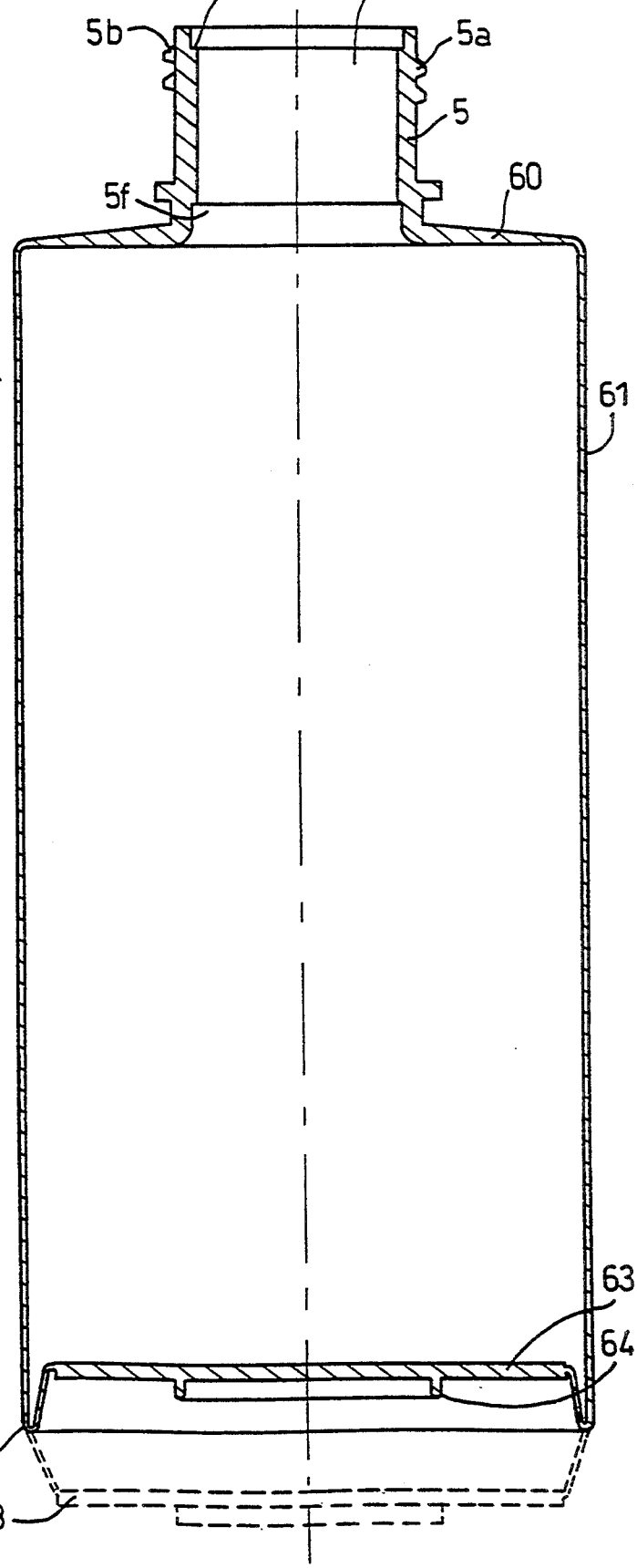
FIG. 9 is a longitudinal section through another tank usable in the FIG. 1 device.
Figure 10:
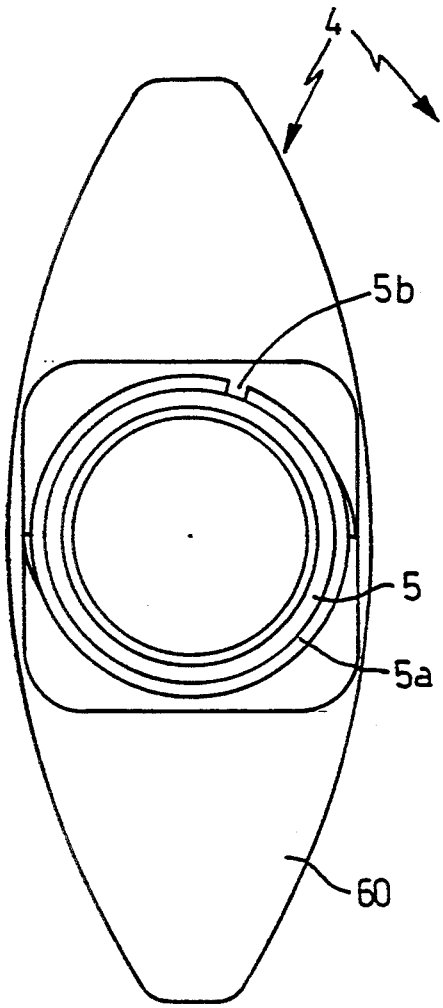
FIG. 10 is a plan view of the FIG. 9 tank.

FIGS. 9 and 10 show another tank that can be used in the device constituting the first embodiment of the invention. The tank 4 of FIGS. 9 and 10 is made of a relatively flexible material such as polyethylene. It includes a neck 5 similar to that shown in FIG. 4. A relatively thick and thus rigid wall 60 extends radially outwards from the neck 5. The wall 60 extends axially downwards in the form of a cylindrical side wall 61 that is thin and thus flexible. The side wall 61 connects to a bottom 63 that is relatively thick, and thus rigid. The bottom 63 advantageously includes an annular rib 64 on its outside face for a purpose explained below. The width of the bottom 63 is slightly less than the space available inside the side wall 61.

The tank 4 is molded while it is in the position shown in dashed lines in FIG. 9, i.e. with its bottom 63 not folded into the side wall 61. Thereafter, the bottom 63 is pushed slightly into the side wall 61 as shown in solid lines in FIG. 9, such that the side wall 61 folds over, thereby forming a fold 62 at the bottom end of the tank.

Seen from above, the tank is oval in shape, but any other shape would also be possible. The neck 5 is centered on the tank 4, but it could alternatively be off-center.

The tank 4 is advantageously filled with the desired fluid under a vacuum, after which the neck 5 is closed by means of a membrane ring as shown in FIGS. 12 to 15: this ensures that the tank does not include an air pocket after it has been closed.

The ring 80 shown in FIG. 12 is made of molded plastic. It has an axial duct 82 that extends between a bottom end 83 and a top end 84. The duct 82 includes a cylindrical side wall 87 which extends from the top end 84 of the duct to a shoulder-forming bottom narrowing 86. A cylindrical wall 88 is formed in the middle of the shoulder 86 and extends a short way into the duct 82, defining the bottom end 83 of the said duct. A tearable membrane 85 is fixed to the bottom end 83 of the duct, e.g. by hot gluing. An inside annular sealing lip 90 is formed at the top end of the wall 88. In addition, the side wall 87 of the duct 82 includes a top outside flange 89 that forms a downwardly-facing shoulder, and a bottom outside flange 93. The flange 93 includes an upwardly-facing shoulder **93*b* and a sloping surface 93*a* that flares upwards from the bottom end of the ring up to the shoulder 93*b***.

The ring 80 is fixed in the neck 5 merely as a push-fit. The sloping surface **93*a* enables the ring 80 to penetrate into the neck 5 and this continues until the top flange 89 of the ring comes into abutment against the shoulder of the top enlarged portion 5*d* of the neck 5. The bottom flange 93 of the ring then snaps into the bottom enlarged portion 5*f* of the neck, with the shoulder 93*b* preventing the ring 80** from being removed.

After the ring 80 has been installed, the tank 4 is closed in sealed manner and can thus be allowed to come into contact with the atmosphere.

When it is desired to mount a pump 6 on the tank 4, the pump 6 is generally assembled to a fixing plug 50 which is screwed onto the neck 5 of the tank. The diameter of the pump body **7*a* is less than the diameter of the side wall 87 of the ring 80, so when the plug 50 begins to be tightened on the neck, the pump body 7 penetrates without sealing into the duct 82 of the ring. Because of the vertical groove 5*b* formed in the threads 5*a* of the neck 5, the air contained in the duct 82 of the ring is free to escape as the pump body moves into the duct. When the inlet end 7*a* penetrates into the central cylindrical wall 88, the inside sealing lip 90 of the wall 88 bears in sealed manner against a periphery of the inlet end 7*a* of the pump body. As the movement continues the inlet end 7*a* of the pump body moves down slightly below the membrane 85, thereby tearing it. Only the volume of air that exists between the lip 90 and the membrane 85 penetrates into the tank 4: since the lip 90 is close to the membrane 82**, this volume is small.

Advantageously, the volume of air that enters the tank 4 when the pump 6 is installed can be minimized or even eliminated by placing the sealing lip 90 in contact with the membrane 85 as shown in FIG. 13. In FIG. 13, the duct 82 is shown as being substantially complementary in shape to the pump body 7 and its inlet end **7*a*. Under such circumstances, it is useful to provide an axial groove 94 inside the duct 82 extending from the top end 84 of the duct to the lip 90 so as to avoid capturing air inside the duct 82 when the pump body is engaged in the duct. It may be observed that it would be possible to omit the groove 94 merely by enlarging the duct 82** sufficiently to ensure that neither the pump body 7 nor its inlet end 7*a* slides in sealed manner inside the duct 82, other than where the sealing lip 90 is engaged.

The membrane 85 may be hot glued on the shoulder 86 and the sealing lip 90 may then be disposed in contact with the membrane 85, on the side of said membrane 85 that faces the bottom end 83 of the duct 82.

In general, the membrane 85 is preferably formed between the sealing lip 90 and the bottom end 83 of the duct 82, including extreme positions where it is against the sealing lip or against the bottom end 83. The tearable membrane 85 may alternatively be integrally molded with the ring 80, as described with reference to FIGS. 31 to 35.

FIGS. 14 and 15 show variants of the ring 80 which require the use of an annular gasket 91, 92 made of elastomer or of other material. In FIGS. 14 and 15, the diameter of the side wall 87 of the ring is large enough for the pump body 7 to engage therein without sealing, and the shoulder 86 of the ring delimits an opening 95 whose diameter is just large enough to allow the inlet end 7*a* of the pump body to penetrate into the opening without sealing.

In FIG. 14 the gasket 91 is mounted to slide with friction on the inlet end 7*a* of the pump body. It makes sealed contact with said inlet end 7*a*, but it slides without sealing inside the side wall 87. It is separated from the bottom of the inlet end 7*a* by a distance d that is substantially equal to the distance e that separates the shoulder 86 from the membrane 85. Thus, when the inlet end 7*a* of the pump body comes into contact with the membrane 85, the gasket 91 also comes into sealing contact against the shoulder 86: it is thus ensured that practically no air penetrates into the tank. It may also be observed that once the plug 50 has been tightened, the shoulder 71 that separates the inlet end 7*a* from the remainder of the pump body 7 compresses the gasket 91 against the shoulder 86, thereby providing excellent and long-lasting sealing.

In FIG. 15, the gasket is mounted to slide over the largest portion of the pump body 7 instead of over its inlet end 7*a*. The volume of air that penetrates into the tank 4 is thus restricted to the annular volume that extends between the inlet end 7*a* and the gasket 92. In this case, the gasket 92 has an axial groove 96 to allow air to escape while the pump body is being pushed into the duct 82.

Figure 11:
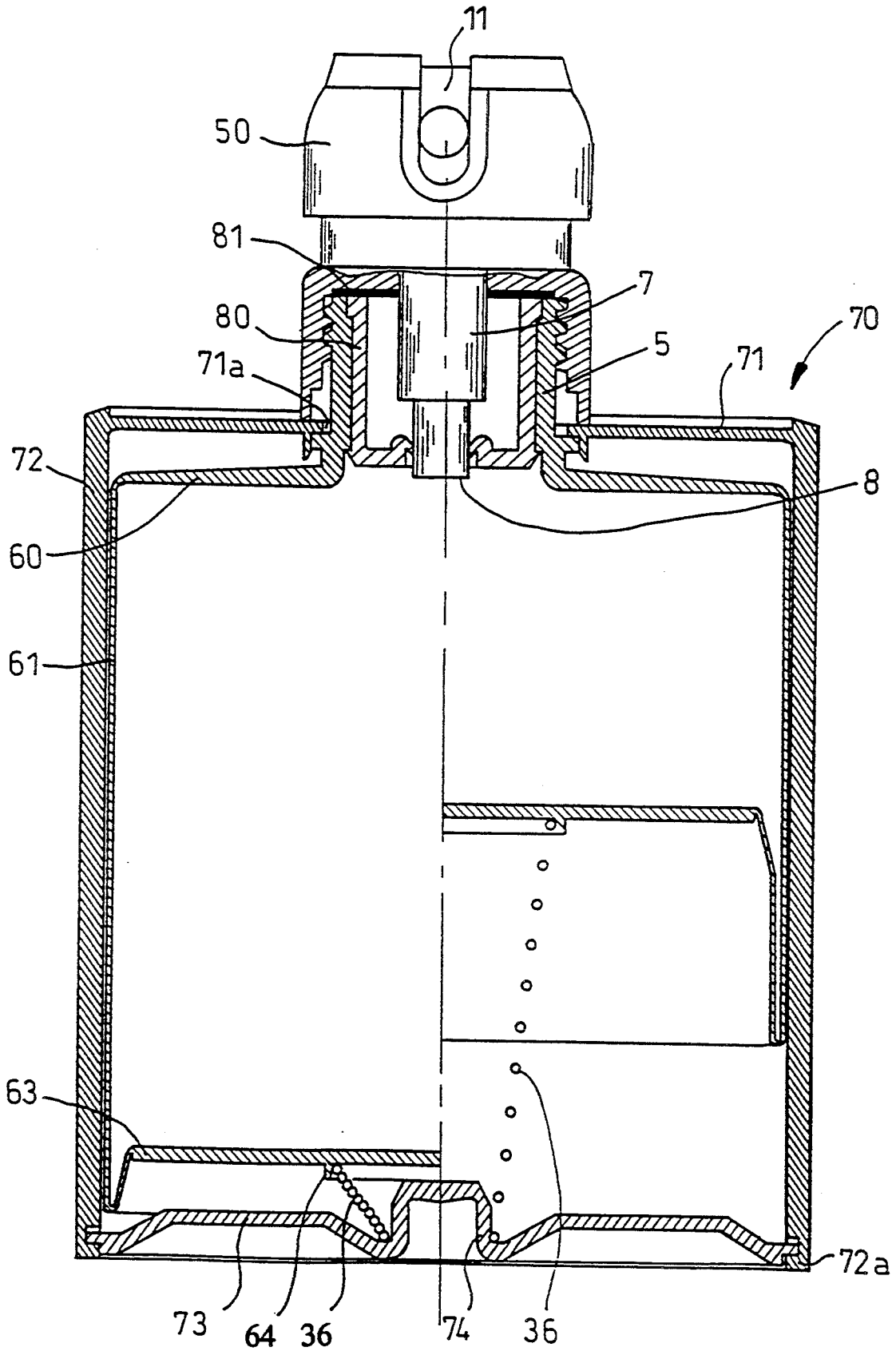
FIG. 11 is a fragmentary longitudinal section through the tank of FIGS. 9 and 10 in the in-use position, the bottom of the tank being shown in two different positions in the lefthand and righthand halves of the drawing.

As shown in FIG. 11, the deformable tank 4 can be slid into a rigid case 70 before the plug 50 is screwed on, and a flat gasket 81 can be interposed between the plug 50 and the neck 5. The case 70 has an annular top wall 71 pierced by a central opening 71*a* through which the neck 5 passes. The top wall 71 extends radially outwards to a side wall 72. The wall 72 extends axially downwards to a bottom end 72*a*. The bottom end 72*a* is open and can receive a bottom 73 which is screwed into place or which is removably fixed by any other known means (e.g. a quarter-turn fixing). Between the bottom 74 of the case and the bottom 63 of the tank, a spring 36 urges the tank bottom 63 upwards. In the example shown, the spring 36 is a force-fit on a central projection 74 of the bottom 73 and is centered on the bottom 63 of the tank by means of an annular rib 64, however the shape of the spring 36 could be different, and it could be installed differently. The spring 36 could optionally be replaced by any other equivalent resilient means.

As the fluid is used up, the bottom 63 moves up inside the side wall 61 folding over itself, as already explained with reference to FIG. 6. The spring 36 maintains sufficient pressure inside the tank 4 to avoid having a portion of the fluid vaporizing and thus creating a pocket of gas that would run the risk of unpriming the pump.

Since the tank does not contain any air or any pocket of gas, the pump 6 remains primed until the tank 4 has been completely emptied. When the bottom 63 of the tank comes into contact with the top wall 60, the pump establishes a high degree of suction inside the tank, thereby causing the folded-back portion of the tank wall to be pressed hard against the non-folded-back portion, such that nearly 100% of the fluid initially contained in the tank can be dispensed, with this being enhanced by the ring 80 eliminating substantially all of the dead volume within the neck 5.

The shape of the tank and the way in which it deforms could be different from the above description. When the tank 4 is cylindrical, the neck 5 is advantageously off-center, so as to be close to the side wall of the box 1. In this way, the lateral nozzle 11 of the pushbutton need not be long in order to reach the vicinity of the outlet orifice 3, and this is particularly favorable for avoiding vibration.

It may be observed that the plug 50 need not be screwed onto the neck 5, but could be screwed inside the ring 80, as in the second embodiment described below (FIGS. 20 to 41).

Figures 16, 17, 18, 19:
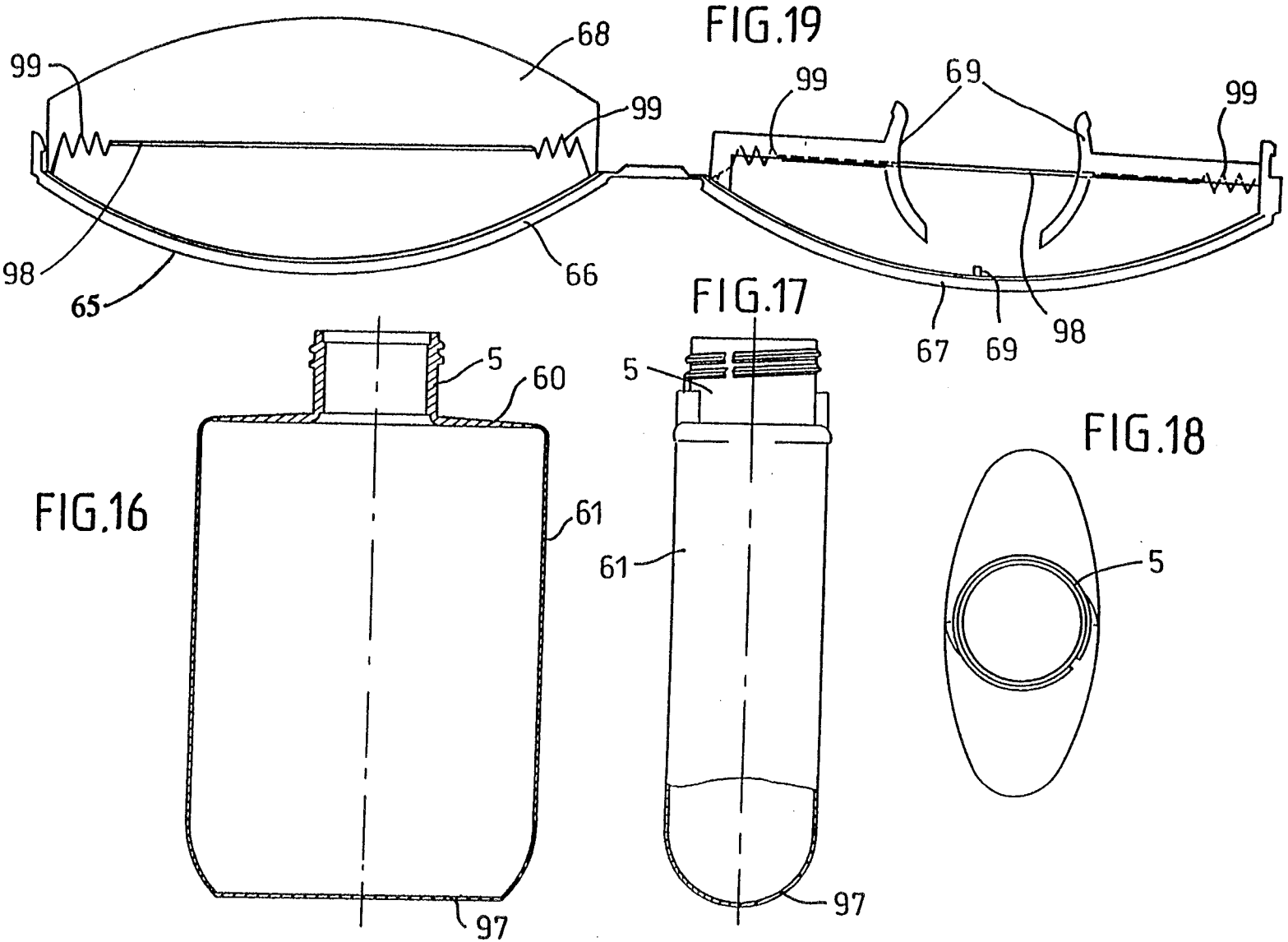
FIG. 16 is a longitudinal section view through another tank suitable for use with the device of FIG. 1.
FIG. 17 is a side view of the FIG. 16 tank.
FIG. 18 is a plan view of the FIG. 16 tank.
FIG. 19 is a plan view of a case suitable for receiving the tank of FIGS. 16 to 18.

For example, as shown in FIGS. 16 to 18, the tank 4 may have a flattened shape in a plane that contains the neck 5. The tank 4 of FIGS. 16 to 18 may be made of polyethylene, for example, and has a top wall 60 which extends radially outwards from the neck 5, which top wall can be thick and thus sufficiently rigid. The tank 4 also includes a flexible side wall 61 which extends axially to a flexible bottom 97, which bottom may be rounded in side view (FIG. 17). The tank 4 is placed in a rigid case 65 which includes resilient means for pressing against the side wall 61 in order to flatten it. In the example shown in FIG. 19, the case comprises two half-shells 66 and 67 which are connected together by means of a hinge, and which can close over the tank by snap-fastening. One of the half-shells 66 includes a bottom 68 while the other half-shell 67 includes means 69 for snap-fastening to the neck 5. In addition, each half-shell includes a plane plate 98 connected to the half-shell by resilient means, in this case spring blades 99 of plastic material that are folded like bellows and that are integrally molded with the plate 98 and the corresponding half-shell. The plane plates 98 are disposed vertically beneath the neck 5 which is not deformable, such that the said neck 5 does not impede flattening of the tank by means of the plates 98 under drive from the springs 99.

In any event, the resilient means engaging the tank cause it to deform uniformly while keeping the deformable walls of the tank under tension: this prevents the walls becoming crumpled under the effect of suction created by the pump, thereby ensuring that the tank can be emptied completely.

In this embodiment, it is possible for the tank 4 to be rigid providing it is partially filled with nitrogen or some other inert gas under pressure, in which case the central duct of the ring 80 must be extended down to the bottom of the tank 4 by means of a dip tube, as in the second embodiment described below.

Second embodiment

In a second embodiment as shown in FIGS. 20 to 40, the device of the invention includes a pump that may be similar to that of FIG. 3 but that operates with an air intake, i.e. that returns air into the tank each time it is actuated. In this embodiment, the tank therefore does not deform as the fluid it contains is used up.

Figure 22:
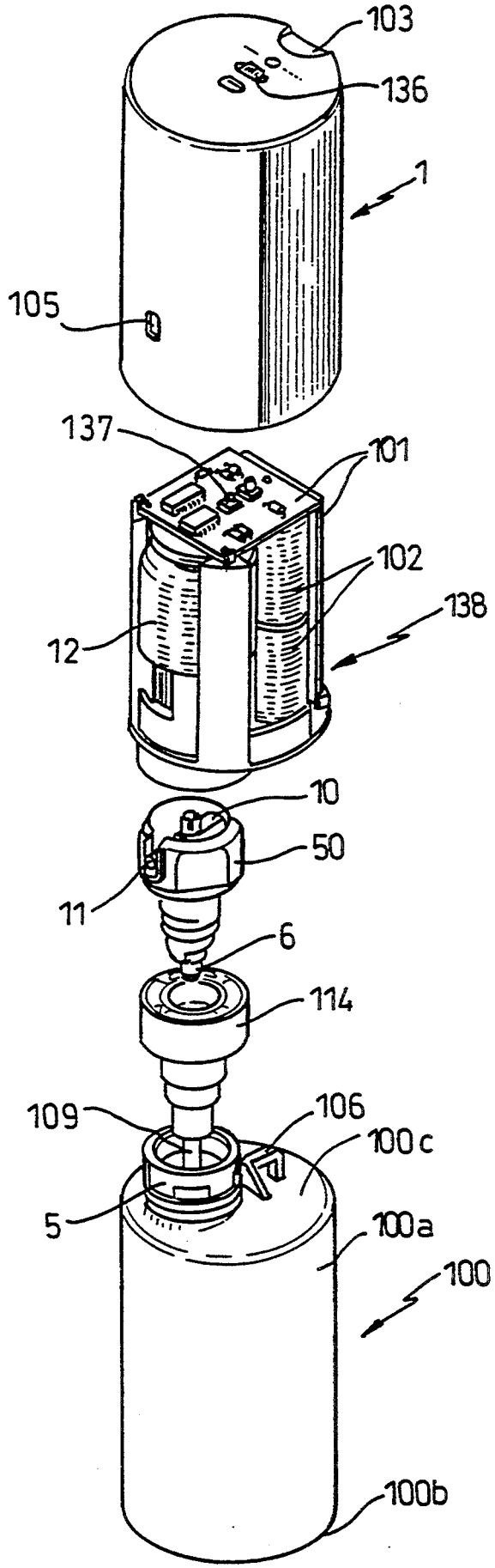
FIG. 22 is an exploded view of the FIG. 20 device.

FIG. 20 is an overall view of the device comprising the second embodiment of the invention, which embodiment is similar in numerous respects to the device constituting the first embodiment. In FIGS. 20 to 40, the same references are used as in FIGS. 1 to 9 for designating items that are identical or similar. The device of FIG. 20 includes an actuator head 1 with a tank 100 of fluid fixed therebeneath. The actuator head 1 includes a control button 103 and an outlet orifice 105 enabling the sprayed fluid to escape. The actuator head 1 also advantageously includes a selector switch 136 e.g. for selecting between an off position, a position which operates stroke-by-stroke, and a position in which operation takes place repetitively at a high rate giving rise to pseudo-continuous spraying. The actuator head 1 may also include an indicator lamp 137, e.g. for indicating the level of charge in a storage battery. FIG. 22 is an exploded view of the FIG. 20 device. The tank 100 may be made of molded plastic, and may include a cylindrical side wall 100*a* that extends axially from a bottom 100*b* to a top wall 100*c* in which an eccentric neck 5 is formed. The tank 100 also includes a loop 106 at the top thereof and extending radially relative to the axis of the neck 5 while also extending axially upwards from the top wall 100*c*. A ring 114 is snapped into the neck 5, which ring is provided with a central duct 108 that receives a dip tube 109 that extends to the bottom of the tank 100. A plug 50 similar to the above-described plug 50 is mounted in the ring 114, and a pump 6 is fixed in the plug 50, the pump 6 being provided with a pushbutton 10 having a lateral nozzle 11 through which the sprayed fluid is expelled. The actuator head 1 comprises an actuator block 138 which includes an electrical circuit 101 for power supply and control purposes, a solenoid 13 connected to the circuit 101 and containing a core 12 for actuating the pushbutton 10, and storage batteries 102.

Figure 27:
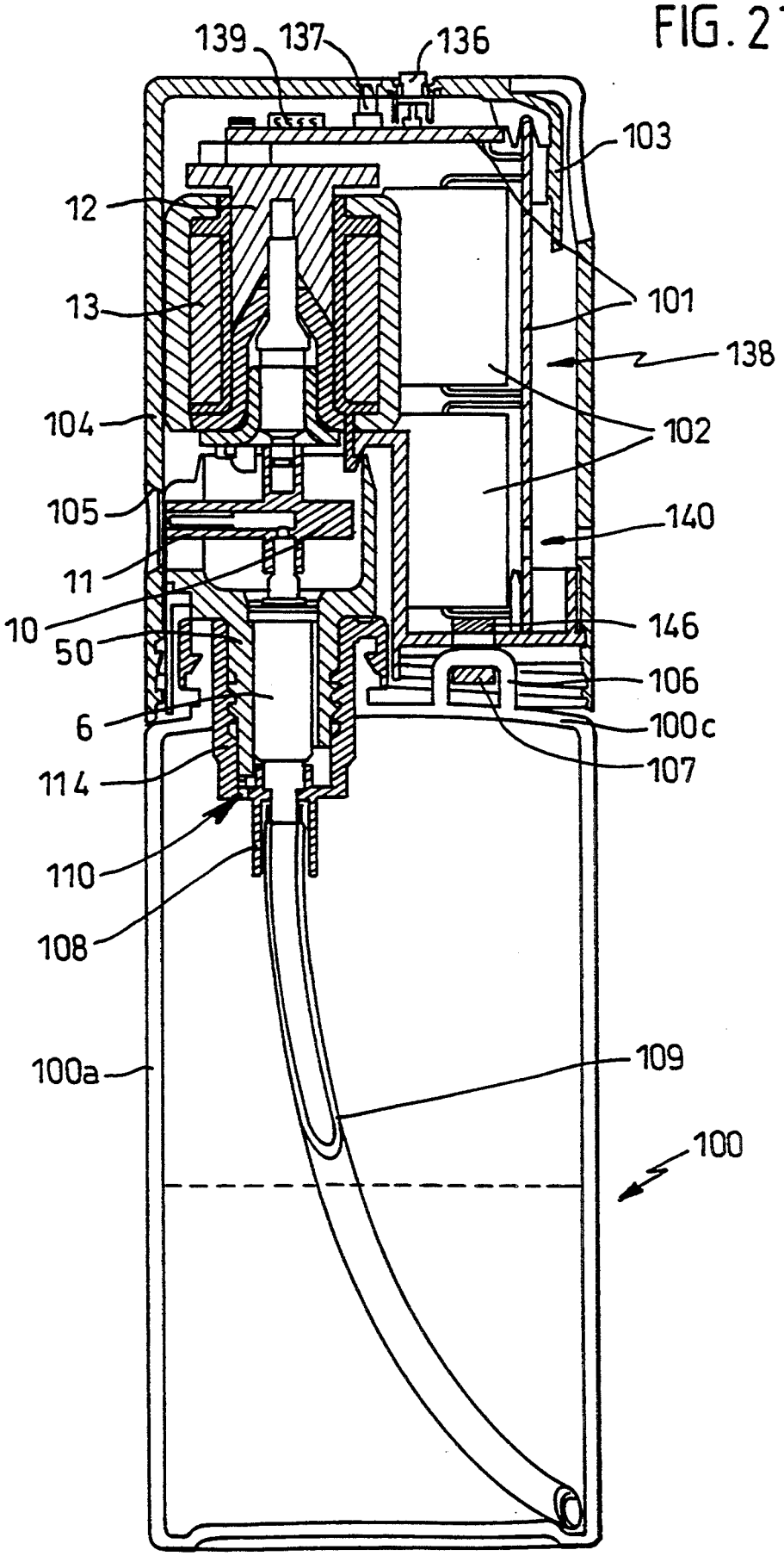
FIG. 27 is a section view of the FIG. 20 device.
Figure 28:
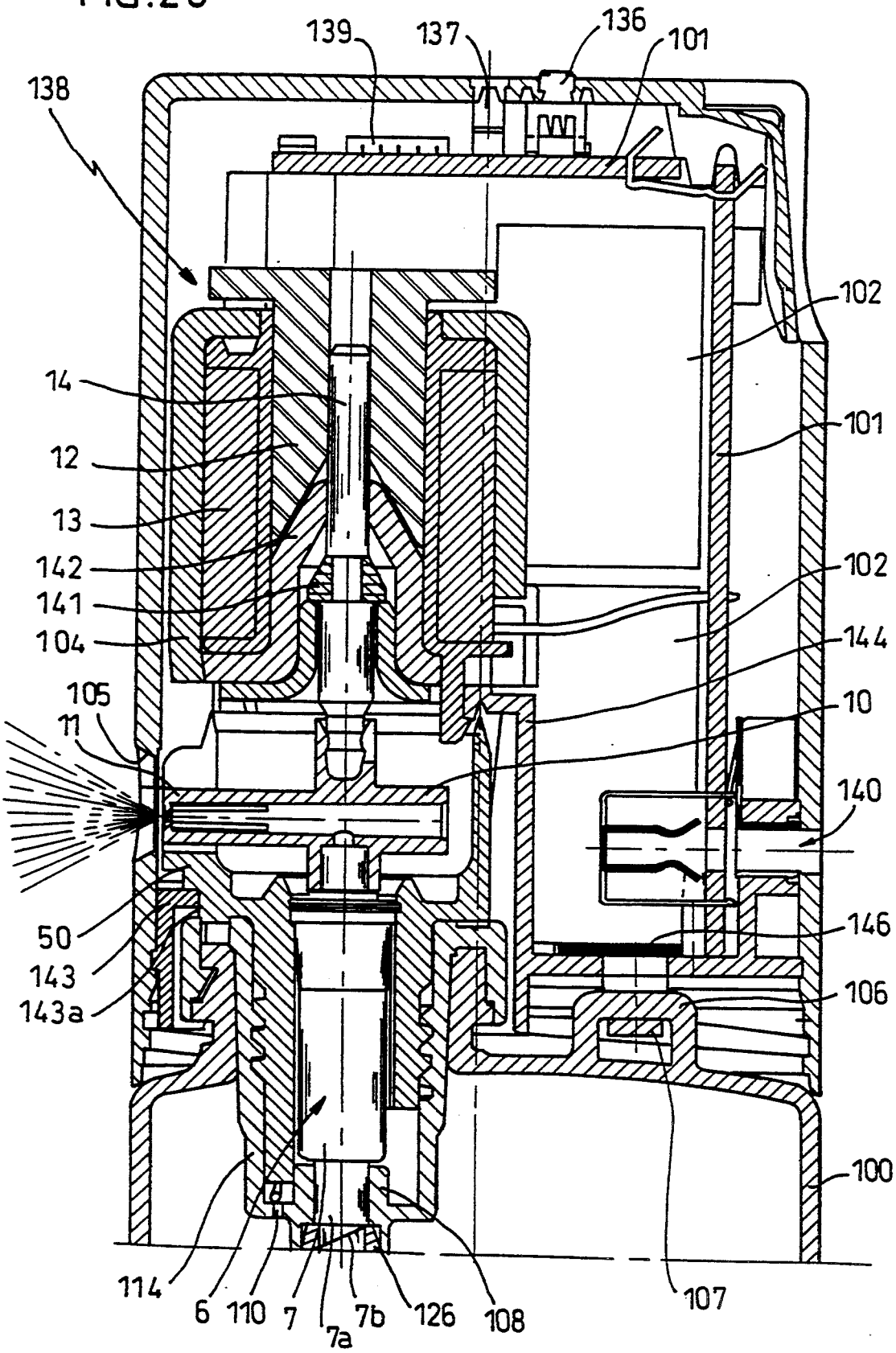
FIG. 28 is a detail view of FIG. 27.
Figures 29, 30, 31:
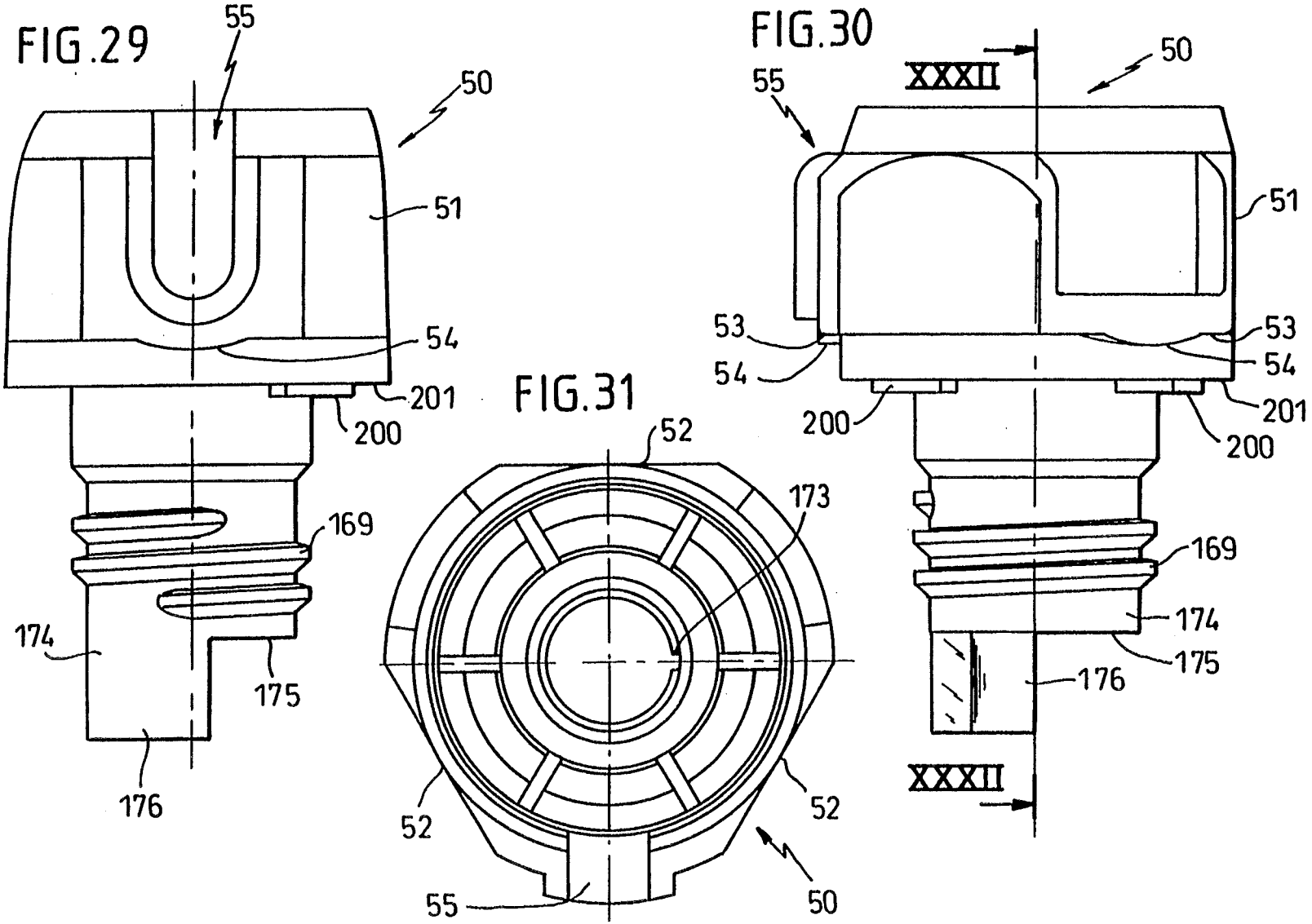
FIG. 29 is a front view of a plug mounted in the neck of the tank of the FIG. 20 device.
FIG. 30 is a side view of the FIG. 29 plug.
FIG. 31 is a plan view of the FIG. 29 plug.

The device is shown in greater detail in FIGS. 27 and 28. The pump 6 is fixed in the plug 50, e.g. by a snap-fit, the plug 50 is screwed inside the ring 114 which is itself snap-fitted in the neck 5 of the tank. The central duct 108 of the ring 114 includes an inner ring 126 that is engaged in sealed manner in said duct, and a dip tube 109 that is engaged in the ring 126. The dip tube 109 could optionally be engaged directly in sealed manner in the central duct 108 of the ring 114. The pump 6 has a pump body 7 with an inlet end 7*a* which is engaged in sealed manner in the central duct 108 of the ring 114 when the plug 50 is screwed into the ring 114. Advantageously, said inlet end 7*a* includes a tip 7*b* suitable for puncturing a frangible membrane 112 that closes the duct 108. The ring 114 also includes an air intake orifice 110 which enables the pump 6 to pass air into the tank 10 each time the pump is actuated.

The actuator head 1 includes a rigid outer shell 104 in which the actuator block 138 is secured. The electronic circuit 101 includes a microprocessor 139 which controls the operation of the device. The circuit 101 also includes the indicator means 137 which may be constituted by one or more light emitting diodes (LEDs), and the selector switch 136. The storage batteries 102 are connected to the electronic circuit 101, and the actuator head 1 includes a socket 140 for connection to a transformer for recharging the batteries 102. The electronic circuit 101 is also connected to the control button 103 which causes the apparatus to operate. The circuit 101 is connected to the solenoid 13 and it feeds electricity to said solenoid 13 each time the pump 6 is to be actuated. A soft iron core 12 slides axially inside the solenoid, and said core 12 includes a rod 14 preferably made of non-magnetic material which extends towards the pushbutton 10, and whose end is removably snap-fastened on said pushbutton 10. The rod 14 is circularly symmetrical about its own axis so as to enable the pushbutton 10 to rotate relative to the rod 14 after snap-fastening. It should be observed that the rod 14 need not be connected to the pushbutton 10, however that solution is not the preferred solution since it can give rise to vibration or to variation in the spraying rate. The rod 14 advantageously includes an annular groove in which a part 141 which is preferably made of shock absorbing material is fixed. The rod 14 passes through a wall 142 secured to the solenoid 13 and to the actuator head 1, and the core 12 is axially displaceable with a certain amount of lost motion between a determined low position where the core 12 comes into abutment against the wall 142, and a determined high position where the part 141 comes into abutment against the wall 142. When the tank 100 is fixed on the actuator head 1, the plug 50 is snap-fastened into a wall 143 perpendicular to the axis of the rod 14 and secured to the actuator head 1, and the axial position of said plug 50 relative to the solenoid 13 is accurately determined by a top abutment of said plug 50 against a wall 144 secured to the actuator head 1, and by a bottom abutment of said plug 50 against said wall 143 in which the plug is snap-fastened. The pump 6 is thus axially positioned very accurately relative to the solenoid 13 such that the push rod 9 of said pump is displaced over a predetermined stroke each time it is actuated, thereby ensuring that the predetermined strokes C1 and C2 occur very accurately each time it is actuated, as described above with reference to FIG. 3.

To fix the tank 100 on the actuator head 1, the plug 50 is initially engaged axially in a recess 143*a* in said wall 143 and having an inside shape substantially complementary to the outside shape of the plug 50, and thus snap-fastening the pushbutton 10 on the end of the rod 14 of the core 12. The rod 14 and the push rod 9 of the pump are then in alignment. The pushbutton 10 is then rotated relative to the head 1 so as to lock the plug 50 on said wall 143 given the outside shape of the plug 50 which is not circularly symmetrical. In addition, the actuator head 1 includes a hook 107 extending at right angles relative to a radius from the common axis of the core 12 and of the pump 6 such that the hook 107 engages in the loop 106 and holds said loop 106. Advantageously, as shown in FIG. 40, the tank 100 may include code marks, e.g. concerning the contents of the tank 100. These marks may be in the form of pale or reflecting spots 145 disposed at the top of the loop 106 so that said spots 145 face towards the actuator head 1 when the tank 100 is mounted on said head 1. The actuator head 1 includes a reader device 146 disposed above the loop 106, said device 146 being connected to the electronic circuit 101. The device 146 may include, for each spot to be detected, an assembly constituted by an LED associated with a lens for directing a beam of light towards said spot, and a photo-transistor for detecting the reflection of said light beam on the spot 145. For example, for each reflecting spot to be detected, it is possible to use an optoelectronic component sold by Siemens under the references SFH 900-2 and SFH 900-5, which component includes an LED, a lens, and a phototransistor. Naturally, other reader devices or other means of encoding information on the tank could also be used. The encoded information is transmitted to the microprocessor 139 which may, for example, prevent the actuator head 1 operating with certain fluids, or prevent it from operating after the use-by date of the fluid contained in the tank 100 has been exceeded, etc.

FIGS. 23 to 26 show the various steps involved when an empty tank 100 on an actuator head 1 is replaced. Firstly, as shown in FIG. 23, the empty tank 100 is disassembled from the actuator head by rotating the tank 100 relative to the actuator head in the direction of arrow 147, after which the tank 100 is separated axially from the actuator head 1 in the direction of arrows 148. The pushbutton 10 is fixed on the actuator rod 9 of the pump more securely than the pushbutton is secured to the rod 14, and as a result the pushbutton 10 comes away with the pump 6 and the tank 100. The plug 50 on which the pump is fixed is unscrewed as shown in FIG. 24, and then the plug 50 is screwed onto a full tank 100 as shown in FIG. 25. Finally, as shown in FIG. 26, the new tank 100 together with its plug 50 is engaged axially in the actuator head 1 in the direction of arrow 149, after which the tank 100 is locked into place on the actuator head 1 by rotating the tank 100 in the direction of arrow 150.

Figure 37:
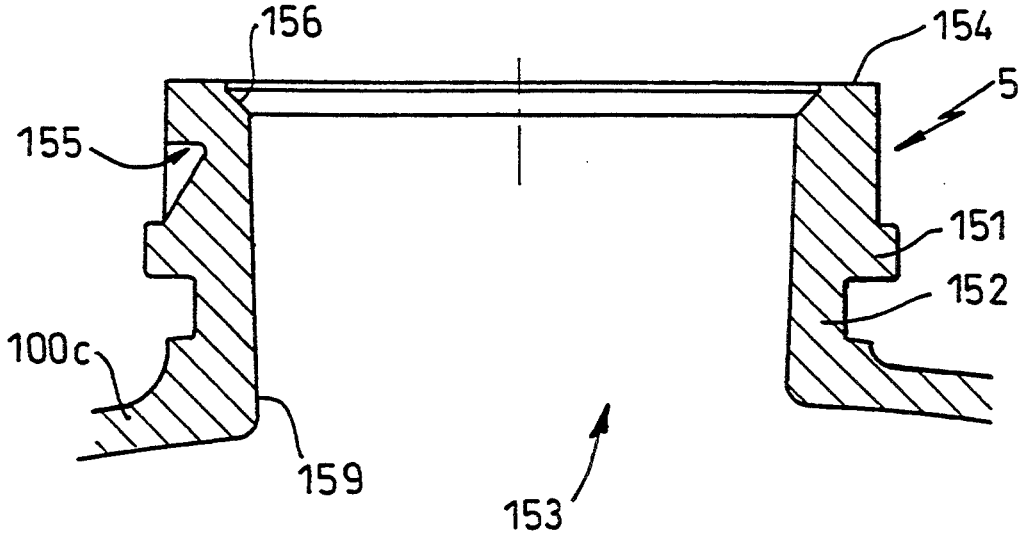
FIG. 37 is a section view through the neck of the tank of the FIG. 20 device.

The neck 5 of the tank 100 is shown in greater detail in FIG. 37. The neck 5 includes a top portion 151 that is relatively thick, and an intermediate portion 152 that is relatively thin and that connects it to the remainder of the tank 100. The neck 5 includes an inside duct 153 which extends axially from the inside of the tank 100 to a top end 154 of the neck 5. The duct 153 is delimited by an inside surface 159 of the neck. The surface 159 flares slightly so that its diameter increases going towards the top end 154 of the neck for reasons that are explained below. In addition, the surface 159 is terminated by a chamfer 156 in the vicinity of the top end 154 of the neck. Finally, the enlarged portion 152 of the neck includes outside snap-fastening housings 155 distributed around its periphery for snap-fastening to the ring 114. Advantageously, the housings 155 are distributed around the periphery of the neck in non-uniform manner so as to constrain the ring 114 to take up a particular angular position relative to the tank 100. The tank 100 may advantageously be molded in a relatively flexible material such as low density polyethylene: the vibration transmitted to the pump body 7 and to the plug is then damped by the tank, and in particular by its side wall 100*a*.

The ring 114 which is snap-fastened inside the neck 5 is shown in greater detail in FIGS. 33 to 36. The ring 114 may be made of molded plastic, and it includes a side wall 160 that is substantially complementary in shape to the inside of the duct 153, i.e. it may taper slightly. The tapering shape provides excellent sealing between the ring 114 and the neck 5, and also participates in damping the vibration caused by actuating the pump. The side wall 160 has internal tapping 166. The wall 160 extends axially between a bottom 161 and an open top end 160*a* which extends radially outwards in the form of a radial cap 168 which is itself axially extended towards the bottom 161 of the ring 114 by an annular side wall 168. When the ring 114 is engaged in the neck 5, the wall 167 overlies said neck 5. In addition, the wall 167 includes inside snap-fastening catches 167*a* which engage in the housings 155 in the neck. The cap 168 includes a passage 168*a* above each of the catches 167*a*. The passages 168*a* enable the catches 167*a* to be molded, and they also serve as vents when assembling the ring 114 on the neck 5.

The bottom 161 of the ring 114 includes the duct 108 that delimits a central orifice 162 and that has a projecting portion 108*d* inside the side wall 160. The central duct 108 includes a portion 108*a* of greater inside diameter towards the inside of the tank 100, which portion is extended by a chamfer 108*b* into the tank 100 so as to receive the above-mentioned dip tube 109 and inner ring 126. As shown in FIG. 33, the central orifice 162 includes a peripheral inside sealing lip 162*a* which provides sealing against the pump body 7.

The chamfer 108*b* includes an inner annular shoulder 108*c* which enables the inside ring 126 to be snap-fastened. The inside ring 126 has a peripheral side wall that engages in the duct 108 and in which the dip tube 109 is engaged. The inside ring 126 also includes, in the top thereof, a frangible membrane 112 which closes the duct 108 and which is broken by the tip 7*b* of the pump body when the plug 50 is put into place on the ring 114, after the pump body has engaged in sealed manner in the peripheral rib 162*a*. The membrane 112 may be integrally molded with the inside ring 126 out of plastic, or else it may be glued or heat sealed on the inside ring 126.

In order to facilitate breaking of the membrane 112, said membrane 112 includes radial grooves 164, with each radial groove 164 extending along a full radius of the membrane 112. As shown in FIG. 33, the membrane 112 may also include a central portion 165 of reduced thickness.

Furthermore, the bottom 161 of the ring 114 includes an air intake orifice 110 disposed adjacent to the central duct 108. As shown in FIG. 36, the duct 110 is closed by a rod 113 molded with the ring 114 and extending axially upwards from a base 113*a* to a free end 113*b*, and which is connected to the bottom 161 by a peripheral bridge of frangible material 163, which bridge may include a non-frangible thicker portion 163*a* on one side that forms a hinge as explained below.

Figure 32:
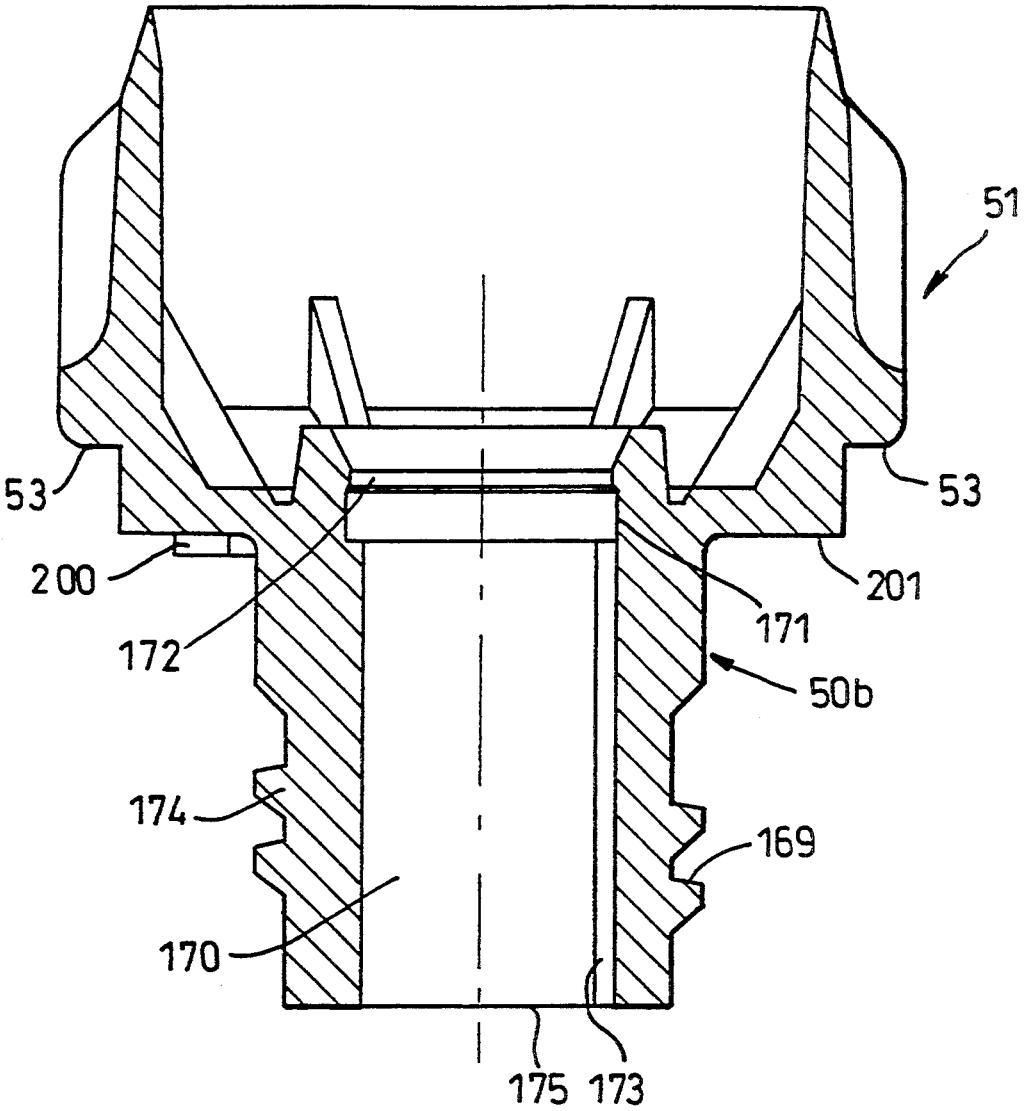
FIG. 32 is a section on line XXXII—XXXII of FIG. 29.

The device also includes a plug 50 shown in FIGS. 29 to 32 which is similar in shape to the plug 50 of the first embodiment of the invention. The fixing plug 50 has a hollow cap 51 provided with at least one outside lateral flat 52, e.g. three flats 52 at 120° to one another. The cap 51 defines an annular shoulder 53 facing the tank 100, and said shoulder 53 includes at least one rounded projection 54 likewise facing the tank, e.g. three projections 54 at 120° to one another. The cap 51 may include a notch 55 for allowing the lateral nozzle of the pump actuating pushbutton to pass and for guiding said lateral nozzle 11 in a vertical plane. The plug 50 may be fixed inside the head 1 by inserting the cap 51 into the orifice 143*a* of complementary shape, and then by rotating the cap 51 so as to lock the projection 54 by snapping it into a complementary recess in the wall 143. As shown in FIG. 32, the plug 50 includes a central duct 170 in which the pump body 7 is snap-fastened. The duct 170 includes a top thickening 171 provided with an inside snap-fastening rib 172 for engaging the pump, and the duct 170 may also include an axial groove 173 which extends over the entire height of said duct 170 and which communicates with the enlarged portion 171 of said duct 170.

In the example shown in FIG. 21, the pump body 7 includes an outside annular flange 134 at its top end, and the piston 15 is held inside the pump body 7 by a bush 130 which includes a cylindrical side wall 131 fixed to the inside of the pump body and an outer annular flange 132 which is superposed on the flange 134 of the pump body. When the pump 6 is mounted in the plug 50, the flanges 132 and 133 are snap-fastened under the rib 172 of said plug. The bush 130 includes an axial outside groove 111 which extends over the entire height of the side wall 131 on the outside of said side wall, and which extends beneath the flange 132 to the radially outer end of said flange 132. The groove 111 opens out into the bottom chamfer **132*a* of the flange 132, said chamfer 132*a* communicating with an axial groove 135 in the flange 133 of the pump body, and said flange 133 itself including a bottom chamfer 134 that communicates with the axial groove 173 of the plug 50 when the pump body is engaged in the inside duct 170 of said plug 50**.

The inside duct 170 of the plug 50 is delimited by a cylindrical side wall 174 provided with an outside thread 169 and which has a bottom end 175 that is extended towards the bottom 161 of the ring 114 by a wall 176 forming a fourth part of a cylinder. When the plug 50 is screwed in the ring 114 after installing the pump 6, the wall 176 interferes with the rod 113 which closes the air intake orifice 110 and pushes said rod over, breaking the bridge of frangible material 163 that used to connect said rod 113 to the bottom 161 of the ring 114. If the bridge 161 includes a thicker portion 164, then the rod 113 may remain attached to the bottom 161 via the thicker portion 164 which then forms a hinge. It would also be possible to open the orifice 110 by engaging the rod 113 in the orifice 110 by means of the plug 50 or the pump body 7: never-the-less that would require the orifice 110 to be larger than the rod 113, with the rod 113 still being connected to the bottom 161 by means of a bridge of frangible material. When the plug 50 is installed on the ring 114, the inlet end **7*a* of the pump body 7 engages firstly in sealed manner with the sealing lip 162*a* of the central orifice 162 of the ring 114. Thereafter, the inlet end 7*a* of the pump body breaks the membrane 112 and is thus put into communication with the dip tube 109. The screw threads 166 and 169 respectively on the ring and on the plug 50 are at an angular disposition such that the notch 55 of the plug 50 that guides the lateral nozzle 11 of the pushbutton in a vertical direction is directed radially towards the cylindrical side wall of the tank on the side where said cylindrical side wall is closest to the neck 5. In addition, the cap 51 of the plug is enlarged at 201 where it joins the side wall 174, the enlargement 201 overlying the radial cap 168 of the ring 114. The enlargement 201 includes projections 200 directed towards said cap 168 and disposed so as to correspond with the above-mentioned passages 168*a*. When the plug 50 is screwed onto the ring 114, the projections 200 snap in non-reversible manner into the passages 168*a*, thereby making it possible to define very accurately the angular position of the plug 50 relative to the ring 114 and to the tank 100 because the passages 168a are distributed in non-uniform manner around the cap 168**.

It may be observed that the ring 114 and the plug 50 could be used in association with a pump that does not have an air inlet and a tank that is deformable, providing the wall 174 of the plug 50 is omitted.

Figure 39:
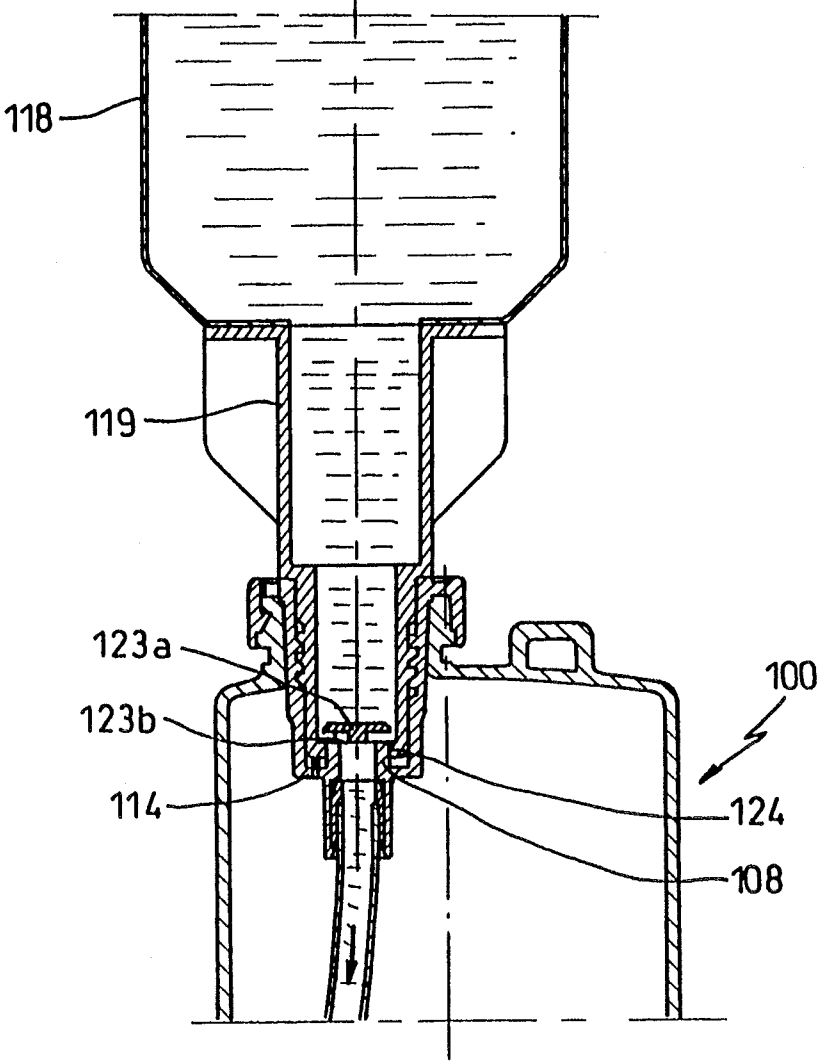
FIG. 39 is a view similar to FIG. 38 but after the refill has been put into place on the tank.
Figure 38:
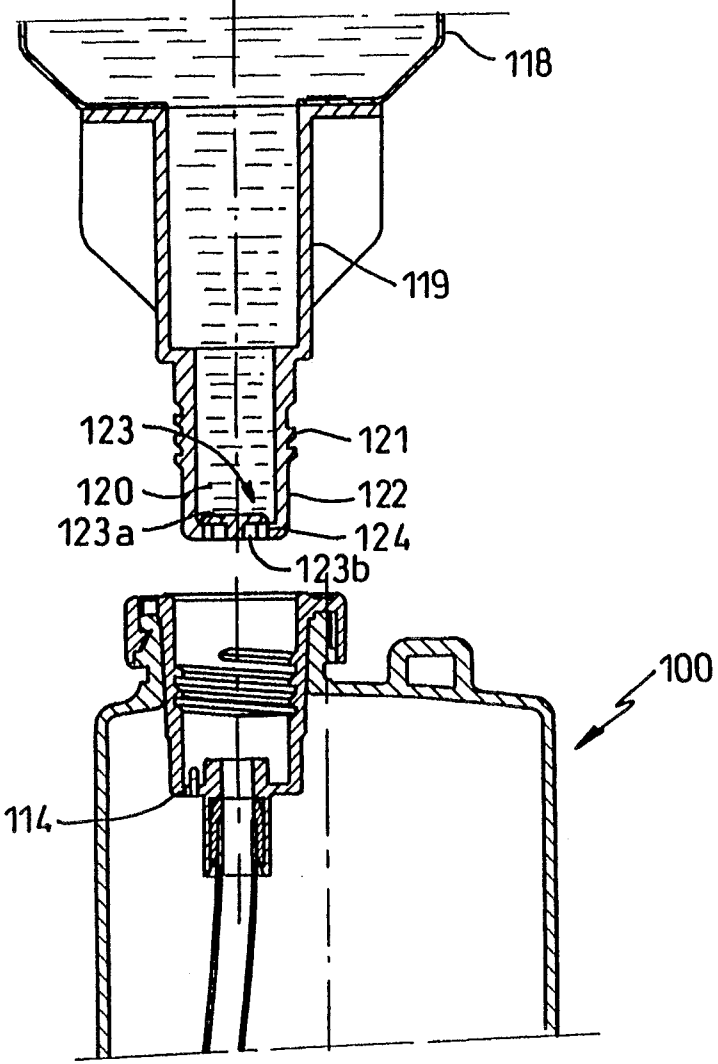
FIG. 38 is a section view of a refill usable for refilling the tank of the FIG. 20 device.

The device constituting the second embodiment of the invention can be refilled not only by replacing the tank 100, but also by literally refilling the tank 100 itself. To do this, it is necessary, or at least preferable, to use a device such as that shown in FIGS. 38 and 39. The device of FIG. 38 includes a flexible tank 118 having a stiffer endpiece 119 that is molded out of plastic, and that has a thread 121 which is identical to the thread of the plug 50. It also has an outlet duct 122 with a central passage 120 and an outlet opening 124 which is initially closed by a plug 123. The plug 123 comprises a plate **123*a* that is integrally molded with the endpiece 119, and that is connected to said endpiece by a peripheral bridge of frangible material. The plate 123*a* extends into the opening 124 of the endpiece 119 via a cruciform rod 123*b*. When the endpiece 119 is screwed into the ring 114, as shown in FIG. 39, the projecting portion 108*d* of the duct 108 bears against the cruciform rod 123*b* and breaks the bridge holding down the plate 123*a* while simultaneously penetrating in sealed manner into the opening 124. When the endpiece 119 is fixed on the ring 114, then the content of the deformable refill 118 can be emptied into the tank 100 of the device by squeezing the deformable tank 118**.

I claim:

1. A rechargeable device for spraying a fluid, comprising:

an actuator head, said actuator head including an actuator member that is movable between a predetermined high position and a predetermined low position and displacing means for displacing said actuator member between said high position and said low position;

a removable tank adapted to contain said fluid, said tank including a neck;

a pump engaged in said neck, said pump having a hollow pump body which defines a cylindrical pump chamber adapted to be filled with said fluid and in which a piston is adapted to slide, the piston being extended axially towards the outside of the pump body by a hollow actuator rod through which said fluid can leave the pump, said pump chamber being in fluid communication with said tank;

a pushbutton fitted with a lateral outlet nozzle and fixed to the actuator rod of the pump, said actuator member being adapted to press against said pushbutton to actuate the pump;

wherein the neck of the tank includes a removable plug on which the pump is fixed, the plug including angular positioning means for positioning said lateral nozzle angularly relative to the actuator head, and accurate axial positioning means for positioning the pump at a determined distance from said displacing means, and wherein the pump body is sealingly engaged in the neck of the tank to establish said communication with said fluid contained in the tank and wherein said pump operates with intake of air, and includes a lateral air intake orifice, the neck of the tank including a central duct which is fitted with a dip tube that extends into the tank, the pump body being sealingly engaged in said central duct, and the neck also includes an air intake passage formed beside the central duct and causing the air intake orifice of the pump to communicate with the inside of the tank, and in which the central duct is provided with a frangible membrane which closes said central duct prior to the plug being installed, and which is then broken by the pump body when the plug is installed on the neck.

2. A rechargeable device for spraying a fluid, comprising:

an actuator head, said actuator head including an actuator member that is movable between a predetermined high position and a predetermined low position and displacing means for displacing said actuator member between said high position and said low position;

a removable tank adapted to contain said fluid, said tank including a neck;

a pump engaged in said neck, said pump having a hollow pump body which defines a cylindrical pump chamber adapted to be filled with said fluid and in which a piston is adapted to slide, the piston being extended axially towards the outside of the pump body by a hollow actuator rod through which said fluid can leave the pump, said pump chamber being in fluid communication with said tank;

a pushbutton fitted with a lateral outlet nozzle and fixed to the actuator rod of the pump, said actuator member being adapted to press against said pushbutton to actuate the pump;

wherein the neck of the tank includes a removable plug on which the pump is fixed, the plug including angular positioning means for positioning said lateral nozzle angularly relative to the actuator head, and accurate axial positioning means for position in the pump at a determined distance from said displacing means, and wherein the pump body is sealingly engaged in the neck of the tank to establish said communication with said fluid contained in the tank and wherein said pump operates with intake of air, and includes a lateral air intake orifice, the neck of the tank including a central duct which is fitted with a dip tube that extends into the tank, the pump body being sealingly engaged in said central duct, and the neck also includes an air intake passage formed beside the central duct and causing the air intake orifice of the pump to communicate with the inside of the tank, and in which the air intake passage is provided with a frangible closure element which closes air intake passage prior to said plug being installed, which is broken while the plug is being installed on the neck.

3. A device according to claim 2, in which said frangible closure element has a projecting portion that interferes with the plug while said plug is being installed.

4. A device according to claim 3, in which said plug is fixed on said neck by being screwed thereon, said frangible closure element is a rod that extends axially between a base and a free end, the base of said rod being connected to the neck by a peripheral bridge of frangible material, and the plug includes a member which extends axially towards the inside of the tank, to correspond with said rod, said member interfering with the free end of the rod by causing said rod to lie down when the plug is screwed onto the neck, thus at least partially breaking said peripheral bridge of frangible material.

5. A device according to claim 2, in which said frangible closure element has a projecting portion which interferes with the pump body while the plug is being installed.

6. A rechargeable device for spraying a fluid, comprising:

an actuator head, said actuator head including an actuator member that is movable between a predetermined high position and a predetermined low position and displacing means for displacing said actuator member between said high position and said low position;

a removable tank adapted to contain said fluid, said tank including a neck;

a pump engaged in said neck, said pump having a hollow pump body which defines a cylindrical pump chamber adapted to be filled with said fluid and in which a piston is adapted to slide, the piston being extended axially towards the outside of the pump body by a hollow actuator rod through which said fluid can leave the pump, said pump chamber being in fluid communication with said tank;

a pushbutton fitted with a lateral outlet nozzle and fixed to the actuator rod of the pump, said actuator member being adapted to press against said pushbutton to actuate the pump;

wherein the neck of the tank includes a removable plug on which the pump is fixed, the plug including angular positioning means for positioning said lateral nozzle angularly relative to the actuator head, and accurate axial positioning means for positioning the pump at a determined distance from said displacing means, and wherein the pump body is sealingly engaged in the neck of the tank to establish said communication with said fluid contained in the tank and wherein said pump operates with intake of air, and includes a lateral air intake orifice, the neck of the tank including a central duct which is fitted with a dip tube that extends into the tank, the pump body being sealingly engaged in said central duct, and the neck also includes an air intake passage formed beside the central duct and causing the air intake orifice of the pump to communicate with the inside of the tank, and in which the neck includes a ring that is snap-fastened in non-reversible manner in said neck, and said ring includes said central duct and said air intake passage.

7. A device according to claim 6, in which the ring is internally tapped, the plug has an outside thread, and the plug is screwed into the ring.

8. A device according to claim 6, in which said angular positioning means for said lateral nozzle comprise relief formed in complementary manner on said ring and said neck to cause said ring to take up a determined angular orientation relative to the tank, the threads on said ring and on said plug co-operating to give the plug a determined angular orientation relative to said ring, said angular positioning means further including means for constraining the tank to take up a determined orientation relative to the head, and guide means for guiding the lateral nozzle of the pushbutton in a plane that has a particular orientation relative to the plug.

9. A device according to claim 8, in which the ring and the plug further include complementary snap-fastening relief for making the plug take up an accurate angular orientation relative to the ring.

10. A rechargeable device for spraying a fluid, comprising:

an actuator head, said actuator head including an actuator member that is movable between a predetermined high position and a predetermined low position and displacing means for displacing said actuator member between said high position and said low position;

a removable tank adapted to contain said fluid, said tank including a neck;

a pump engaged in said neck, said pump having a hollow pump body which defines a cylindrical pump chamber adapted to be filled with said fluid and in which a piston is adapted to slide, the piston being extended axially towards the outside of the pump body by a hollow actuator rod through which said fluid can leave the pump, said pump chamber being in fluid communication with said tank;

a pushbutton fitted with a lateral outlet nozzle and fixed to the actuator rod of the pump, said actuator member being adapted to press against said pushbutton to actuate the pump;

wherein the neck of the tank includes a removable plug on which the pump is fixed, plug is being fixed in a ring engaged in the neck of the tank, the neck has an inside surface that is slightly flared, becoming larger towards the outside of the tank, and the ring has a complementary tapering surface that rests against the flared inside surface of the neck to damp vibration, the plug including angular positioning means for positioning said lateral nozzle angularly relative to the actuator head, and accurate axial positioning means for positioning the pump at a determined distance from said displacing means, and wherein the pump body is sealingly engaged in the neck of the tank to establish said communication with said fluid contained in the tank.

11. A rechargeable device for spraying a fluid, comprising:

an actuator head, said actuator head including an actuator member that is movable between a predetermined high position and a predetermined low position and displacing means for displacing said actuator member between said high position and said low position;

a removable tank adapted to contain said fluid, said tank including a neck;

a pump engaged in said neck, said pump having a hollow pump body which defines a cylindrical pump chamber adapted to be filled with said fluid and in which a piston is adapted to slide, the piston being extended axially towards the outside of the pump body by a hollow actuator rod through which said fluid can leave the pump, said pump chamber being in fluid communication with said tank;

a pushbutton fitted with a lateral outlet nozzle and fixed to the actuator rod of the pump, said actuator member being adapted to press against said pushbutton to actuate the pump;

wherein the neck of the tank includes a removable plug on which the pump is fixed, the plug including angular positioning means for positioning said lateral nozzle angularly relative to the actuator head, and accurate axial positioning means for positioning the pump at a determined distance from said displacing means, and wherein the pump body is sealingly engaged in the neck of the tank to establish said communication with said fluid contained in the tank, and in which the plug includes a first portion close to the tank and having an outside shape which is circularly symmetrical about the axis of the actuator member, and a second portion at a distance from the tank and having an outside shape which is not circularly symmetrical, the head including a latching wall substantially perpendicular to the axis of the actuator member, said latching wall having a recess of a shape that is substantially complementary to the outside shape of the first portion of the plug, said recess being centered relative to the actuator member of the actuator head, the pushbutton is engaged in removable manner on the actuator member when the plug is axially engaged in said recess, and the plug is locked on said latching wall by rotating the tank and the plug about the axis of the actuator member, the tank further including a loop close to the actuator head and extending radially relative to the axis of the actuator member, and said actuator head including a hook extending orthogonally to a radius so as to hook onto the loop at the end of said rotary movement of the tank and the plug.

12. A rechargeable device for spraying a fluid, comprising:

an actuator head, said actuator head including an actuator member that is movable between a predetermined high position and a predetermined low position and displacing means for displacing said actuator member between said high position and said low position;

a removable tank adapted to contain said fluid, said tank including a neck;

a pump engaged in said neck, said pump having a hollow pump body which defines a cylindrical pump chamber adapted to be filled with said fluid and in which a piston is adapted to slide, the piston being extended axially towards the outside of the pump body by a hollow actuator rod through which said fluid can leave the pump, said pump chamber being in fluid communication with said tank;

a pushbutton fitted with a lateral outlet nozzle and fixed to the actuator rod of the pump, said actuator member being adapted to press against said pushbutton to actuate the pump;

wherein the neck of the tank includes a plug on which the pump is fixed, the plug including angular positioning means for positioning said lateral nozzle angularly relative to the actuator head, wherein said angular positioning means on said plug includes a notch for passing the lateral nozzle of the pump-actuating push-button and for guiding said lateral nozzle in a vertical plane, and accurate axial positioning means for positioning the pump at a determined distance from said displacing means, and wherein the pump body is sealingly engaged in the neck of the tank to establish said communication with said fluid contained in the tank.

13. A device according to claim 12, in which the pump operates with intake of air, and includes a lateral air intake orifice, the neck of the tank including a central duct which is fitted with a dip tube that extends into the tank, the pump body being sealingly engaged in said central duct, and the neck also includes an air intake passage formed beside the central duct and causing the air intake orifice of the pump to communicate with the inside of the tank.

14. A refill for a device according to claim 13, for filing the tank of said device after it has been emptied by said pump, the refill comprising:

a deformable receptacle capable of being compressed by a user; and an endpiece having fixing means that are substantially identical to those of the plug to enable it to be removably fixed in the neck of the tank instead of the plug, said endpiece terminating in an outlet duct provided with an outlet channel that communicates with said deformable receptacle, and which is adapted to engage the central duct of the neck in sealed manner when said endpiece is fixed on said neck.

15. A refill according to claim 14, for a device having a central duct provided with a projecting portion directed towards the pump body, said refill having an outlet duct closed by a plug capable of opening the outlet duct by being engaged in the outlet duct, said outlet duct of the refill being adapted to be engaged in sealed manner in said projection portion of the central duct of the tank, and said plug being adapted to come into abutment against said projecting portion during such engagement so as to open the outlet duct of the refill.

16. A device according to claim 13, wherein said dip tube is removable along with said removable tank.

17. A device according to claim 12, in which the pump operates without air intake, the tank is deformable, the neck includes a frangible membrane which closes said neck before the plug is fixed thereto and which is torn by the pump body while the plug is being fixed to the neck, and the neck includes sealing means which co-operate with complementary sealing means displaceable with the pump body to establish sealing between the neck and the pump body no later when the pump body breaks said frangible membrane.

18. A device according to claim 17, wherein said tank is refillable.

19. A device according to claim 17, in which the neck includes a central duct which extends axially between a first end and a second end, the duct including peripheral internal relief constituting said sealing means, and said frangible membrane is disposed between said inside relief and the first end of said central duct.

20. A device according to claim 19, in which said peripheral inside relief is formed in the vicinity of the frangible membrane.

21. A device according to claim 19, in which said sealing means of the duct include an annular lip formed on the inside of said duct and adapted to bear radially in sealing manner against the pump body.

22. A device according to claim 19, in which said sealing means of the duct include a shoulder formed in the duct between the frangible membrane and the second end thereof, said shoulder facing towards said second end, said shoulder being adapted to provide sealing in association with an annular gasket when said annular gasket comes into abutment against the shoulder, said annular gasket being slidably mounted with friction and with sealing engagement on the pump body and sliding without lateral sealing relative to the duct.

23. A device according to claim 17, in which the neck is formed at the top of the tank.

24. A device according to claim 23, in which the tank includes at least one deformable wall, said deformable wall being adapted to move between a first position in which the tank defines a maximum inside volume and a second position in which the tank defines substantially zero inside volume, and it further includes resilient means which urge said deformable wall towards its second position with sufficient force to establish pressure in the vicinity of the neck greater than the vaporization pressure of said fluid at ambient temperature, regardless of the position of said deformable wall.

25. A device according to claim 24, in which said pressure is at least equal to atmospheric pressure.

26. A device according to claim 24, in which said pressure is at least 20 kPa greater than atmospheric pressure.

27. A device according to claim 24, in which the deformable wall includes a rigid bottom and a flexible side wall, said resilient means urging the rigid bottom towards the neck, and when the volume of fluid contained in the tank diminishes, the bottom of the deformable wall moves towards the neck, progressively folding said flexible side wall over onto itself.

28. A device according to claim 27, in which the rigid bottom is thick so as to guide its displacement towards the neck.

29. A device according to claim 27, in which the tank is placed in a rigid case that is substantially complementary in shape to the side wall of said tank.

30. A device according to claim 17, in which said neck includes a ring snap-fastened in non-reversible manner in said neck, and said ring includes the frangible membrane and the sealing means.

31. A device according to claim 17, in which said plug includes air-passing means for allowing the air compressed between said plug and said sealing means of the neck to escape to the atmosphere when the plug is installed on the neck.

32. A device according to claim 12, in which the tank includes a peripheral side wall that is not circularly symmetrical relative to said neck, a portion of said neck lying in the vicinity of the side wall, and the lateral nozzle of the pushbutton points towards said portion of the neck.

33. A device according to claim 12, in which said tank is made of low density polyethylene in order to damp vibration.

34. A device according to claim 12, in which the tank includes means for carrying coded information, so as to enable coded information to be written on said tank, and an electronic circuit for control and power supply purposes which includes reader means for reading said coded information, said reader means being connected to control means for enabling or disabling operation of the actuator head as a function of said information as read.

35. A device according to claim 12, in which said angular positioning means for said lateral nozzle include means for imposing a given orientation on the plug relative to the head, and guide means for guiding the lateral nozzle of the pushbutton in a plane having a particular orientation relative to the plug.

36. A device according to claim 35, in which the means for imparting a particular orientation to the plug relative to the head include snap-fastening relief formed on the plug and complementary relief formed in the head.

37. A device according to claim 12, further including a rigid outer shell provided with an outlet orifice and covering said actuator head, means being provided on said shell and means being provided on said tank for securing said shell to said tank in a relative angular position such that said nozzle is in alignment with said orifice, said orifice enabling the sprayed fluid to escape.

* * * * *